US009850621B2

(12) United States Patent
Morin et al.

(10) Patent No.: US 9,850,621 B2
(45) Date of Patent: Dec. 26, 2017

(54) DRYER MONITORING

(71) Applicant: Ecolab USA Inc., St. Paul, MN (US)

(72) Inventors: Victor N. Morin, Apple Valley, MN (US); Beth V. Boehne-Schickert, White Bear Lake, MN (US); Julio R. Panama, Blaine, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 14/936,264

(22) Filed: Nov. 9, 2015

(65) Prior Publication Data

US 2016/0060806 A1 Mar. 3, 2016

Related U.S. Application Data

(62) Division of application No. 13/273,805, filed on Oct. 14, 2011, now Pat. No. 9,206,543.

(51) Int. Cl.
*D06F 58/28* (2006.01)

(52) U.S. Cl.
CPC ..... *D06F 58/28* (2013.01); *D06F 2058/2816* (2013.01); *D06F 2058/2819* (2013.01); *D06F 2058/2829* (2013.01); *D06F 2058/2883* (2013.01); *D06F 2058/2896* (2013.01)

(58) Field of Classification Search
CPC ..... D06F 58/28; D06F 2058/28; D06F 2058/2816; D06F 2058/2819; D06F 2058/2822; D06F 2058/2825; D06F 2058/2829; F26B 3/00; F26B 3/02; F26B 11/02; F26B 11/04
USPC ..... 34/491, 497, 572, 550, 524
See application file for complete search history.

(56) References Cited

U.S. PATENT DOCUMENTS

| | | | | |
|---|---|---|---|---|
| 2,717,455 A | | 9/1955 | Harris et al. | |
| 3,510,957 A | | 5/1970 | Jarvis | |
| 3,870,145 A | | 3/1975 | Mizuno | |
| 4,019,259 A | | 4/1977 | Veraart | |
| 4,231,166 A | * | 11/1980 | McMillan | D06F 58/28 219/400 |
| 4,385,452 A | | 5/1983 | Deschaaf et al. | |
| 4,481,786 A | | 11/1984 | Bashark | |

(Continued)

FOREIGN PATENT DOCUMENTS

| | | |
|---|---|---|
| DE | 19611324 A1 | 10/1996 |
| EP | 3709516 A1 | 5/1996 |

(Continued)

OTHER PUBLICATIONS

Genskow et al., "Psychrometry, Evaporative Cooling, and Solids Drying," Perry's Chemical Engineers' Handbook, Eighth Edition, Section 12, Oct. 26, 2007, pp. 12-1, 12-5,12-14.

(Continued)

*Primary Examiner* — David J Laux
(74) *Attorney, Agent, or Firm* — Shumaker & Sieffert, P.A.

(57) ABSTRACT

A dryer monitoring system receives dryer information from one or more sensors concerning operation of one or more dryers, such as clothes dryers. For example, the dryer monitoring system may receive temperature and/or humidity information from one or more dryers. The dryer monitor analyzes the dryer data to determine whether textiles in the dryer are dry. The dryer monitor may analyze one or more states and/or one or more indicators (patterns in the dryer data) during the dryness determination.

7 Claims, 11 Drawing Sheets

(56) References Cited

U.S. PATENT DOCUMENTS

| | | | | |
|---|---|---|---|---|
| 4,549,362 | A | 10/1985 | Haried | |
| 4,763,425 | A | 8/1988 | Grennan | |
| 4,827,627 | A | 5/1989 | Cardoso | |
| 5,050,313 | A * | 9/1991 | Wakaeya | F26B 21/06 34/454 |
| 5,166,592 | A | 11/1992 | Bashark | |
| 5,193,292 | A | 3/1993 | Hart et al. | |
| 5,281,956 | A | 1/1994 | Bashark | |
| 5,347,727 | A | 9/1994 | Kim | |
| 5,412,291 | A | 5/1995 | Payne et al. | |
| 5,560,124 | A | 10/1996 | Hart et al. | |
| 5,649,372 | A * | 7/1997 | Souza | D06F 58/28 34/491 |
| 5,675,911 | A | 10/1997 | Moser | |
| 5,682,684 | A | 11/1997 | Wentzlaff et al. | |
| 5,852,881 | A | 12/1998 | Kuroda et al. | |
| 5,899,005 | A | 5/1999 | Chen et al. | |
| 6,061,668 | A | 5/2000 | Sharrow | |
| 6,104,987 | A | 8/2000 | Farnsworth | |
| 6,122,840 | A | 9/2000 | Chbat et al. | |
| 6,141,887 | A | 11/2000 | Chen et al. | |
| 6,446,357 | B2 | 9/2002 | Woerdehoff et al. | |
| 6,484,417 | B2 | 11/2002 | Tedman et al. | |
| 6,493,963 | B1 | 12/2002 | England | |
| 6,519,871 | B2 | 2/2003 | Gardner et al. | |
| 6,745,496 | B2 | 6/2004 | Cassella | |
| 6,775,923 | B2 | 8/2004 | Do | |
| 6,779,740 | B1 | 8/2004 | Lentsch et al. | |
| 6,845,290 | B1 | 1/2005 | Wunderlin et al. | |
| 6,910,640 | B2 | 6/2005 | Griese et al. | |
| 6,931,759 | B2 | 8/2005 | Jeong et al. | |
| 6,931,760 | B2 | 8/2005 | Yang | |
| 6,968,632 | B2 | 11/2005 | Guinibert et al. | |
| 6,988,375 | B2 | 1/2006 | Bashark | |
| 7,005,618 | B2 | 2/2006 | Riddle et al. | |
| 7,313,874 | B2 | 1/2008 | Park | |
| 7,412,783 | B2 | 8/2008 | Guinibert et al. | |
| 7,478,486 | B2 | 1/2009 | Wunderlin et al. | |
| 7,526,956 | B2 | 5/2009 | Muzzolini | |
| 7,594,343 | B2 | 9/2009 | Woerdehoff et al. | |
| 7,971,371 | B2 | 7/2011 | Beaulac | |
| 8,782,922 | B2 | 7/2014 | May et al. | |
| 9,206,543 | B2 | 12/2015 | Morin et al. | |
| 2002/0000049 | A1 * | 1/2002 | Woerdehoff | D06F 58/28 34/313 |
| 2002/0174564 | A1 | 11/2002 | England | |
| 2003/0034443 | A1 * | 2/2003 | Kouznetsov | D06F 58/28 250/222.2 |
| 2003/0195130 | A1 | 10/2003 | Lentsch et al. | |
| 2004/0123486 | A1 | 7/2004 | Hameed et al. | |
| 2004/0168343 | A1 | 9/2004 | Park | |
| 2005/0066999 | A1 | 3/2005 | Dietz et al. | |
| 2005/0091875 | A1 | 5/2005 | Kim | |
| 2005/0091876 | A1 | 5/2005 | Yang | |
| 2005/0183209 | A1 | 8/2005 | Costa et al. | |
| 2006/0191161 | A1 | 8/2006 | Wunderlin et al. | |
| 2007/0256321 | A1 | 11/2007 | Bae et al. | |
| 2008/0072448 | A1 | 3/2008 | Hubig et al. | |
| 2008/0104860 | A1 | 5/2008 | Muenzner et al. | |
| 2008/0184588 | A1 | 8/2008 | Somod et al. | |
| 2008/0264111 | A1 | 10/2008 | Giordano | |
| 2009/0126220 | A1 | 5/2009 | Nawrot et al. | |

FOREIGN PATENT DOCUMENTS

| | | | |
|---|---|---|---|
| EP | 3816551 | A2 | 1/1998 |
| EP | 3863244 | A2 | 9/1998 |
| JP | 4039000 | A | 2/1992 |
| JP | 4109999 | A | 4/1992 |
| JP | 4285599 | A | 10/1992 |
| JP | 5115688 | A | 5/1993 |
| JP | 10043498 | | 2/1998 |
| JP | 10197152 | A | 7/1998 |
| JP | 11235499 | A | 8/1999 |
| JP | 2001194067 | A | 7/2001 |
| JP | 2004321766 | A | 11/2004 |
| JP | 2008194153 | A | 8/2008 |
| KR | 19950018837 | | 7/1995 |
| KR | 20020076590 | A | 10/2002 |
| KR | 20040110812 | A | 12/2004 |
| KR | 20050118484 | A | 12/2005 |
| KR | 100962315 | B1 | 6/2010 |
| WO | 2008049534 | A1 | 5/2008 |

OTHER PUBLICATIONS

Koebbe et al., "Use of Recurrence Plots in the Analysis of Time-Series Data," University of California—Santa Cruz; Rush-Pres.—St. Luke's Medical Center, Chicago, IL Sep. 29, 1994, 7 pp.

Office Action from U.S. Appl. No. 14/936,207, dated Jan. 6, 2017, 5 pp.

Office Action from U.S. Appl. No. 14/936,231, dated Jan. 6, 2017, 4 pp.

Amendment in Response to Office Action dated Jan. 6, 2017, from U.S. Appl. No. 14/936,207, filed Apr. 6, 2017, 6 pp.

Amendment in Response to Office Action dated Jan. 6, 2017, from U.S. Appl. No. 14/936,231, filed Apr. 6, 2017, 7 pp.

Notice of Allowance from U.S. Appl. No. 14/936,207, dated Apr. 18, 2017, 7 pp.

Notice of Allowance from U.S. Appl. No. 14/936,231, dated May 3, 2017, 5 pp.

Genskow et al., "Psychrometry, Evaporative Cooling, and Solids Drying," Perry's Chemical Engineers' Handbook, Eighth Edition, Section 12, Oct. 26, 2007, pp.12-1, 12-5,12-14.

Karmakar et al., "Novel Feature for Quantifying Temporal Variability of Poincare Plot: A Case Study," Biomed Eng Online, Aug. 13, 2009, 4 pages.

Koebbe et al., "Use of Recurrence Plots in the Analysis of Time-Series Data," University of California-Santa Cruz; Pres.-St. Luke's Medical Center, Chicago, IL Sep. 29, 1994, 7 pages.

Prosecution History from U.S. Appl. No. 13/273,805, dated Oct. 8, 2014 through Nov. 5, 2015, 60 pp.

Prosecution History from U.S. Appl. No. 11/526,515, dated Apr. 3, 2009 through Sep. 9, 2015, 256 pp.

Prosecution History from U.S. Appl. No. 12/954,006, dated Aug. 16, 2013 through Mar. 13, 2014, 26 pp.

* cited by examiner

DRYER MONITORING

CROSS REFERENCE TO RELATED APPLICATIONS

This application is a divisional of U.S. application Ser. No. 13/273,805, filed on Oct. 14, 2011, entitled, "DRYER MONITORING," which is incorporated herein by reference in its entirety.

TECHNICAL FIELD

The disclosure relates to the monitoring of dryers, such as clothes dryers.

BACKGROUND

Institutional laundry settings, such as hotels, hospitals, or other commercial laundry establishments, may include tens or hundreds of clothes dryers. In such settings, operators typically set the dryer temperature to medium or high, and select the drying time to ensure that the textiles in the dryer will be completely dry when the cycle is completed. As a result, there is a high frequency of overdrying the textiles. Overdrying may result in premature textile degradation and/or damage, excess energy consumption, and an associated increase in energy costs.

Typical commercial clothes dryers do not have settings or dials to specifically address different fabric types: cotton, polyester, poly-cotton blends, nylon, delicates, etc. Also the operator normally does not have the option to select a predetermined desired level of dryness, such as damp, almost dry, dry, or very dry.

The drying conditions are also highly variable. For example, the dryers may range in sizes from 75 lb up to 500 lbs, with a broad range of BTU/hr, and extremely variable ambient air intake. Depending upon whether the ambient air intake is taken from inside the laundry room or from the outdoors, the ambient air intake can range from dry and very cold in the winter to hot and humid in the summer. The size and efficiency of the dryer, the lack of adjustable features in the dryer, the variability of the temperature and humidity of the air intake, the type and amount of textiles to be dried, the residual moisture content of the textile going to the dryer, and other factors may drastically affect the drying cycle and the dry endpoint.

SUMMARY

In general, the disclosure is related to systems and/or methods for determining dryness of items in a dryer, such as a clothes dryer.

In one example, the disclosure is directed to a method comprising receiving temperature information associated with a dryer cycle of a clothes dryer, receiving humidity information associated with the dryer cycle, determining whether one or more of a plurality of states indicative of dryer conditions associated with dryness of textiles in the dryer are satisfied based on the temperature information and the humidity information, calculating a global state score based on a number of states that are satisfied, determining whether one or more of a plurality of indicators indicative of patterns in the dryer conditions over time associated with dryness of the textiles in the dryer are satisfied based on the temperature information and the humidity information, calculating a global indicator score equal to a number of indicators that are satisfied, and determining that the textiles are dry if the global state score is greater than or equal to a first predetermined global state score and the global indicator score is greater than or equal a first predetermined global indicator score.

In another example, the disclosure is directed to a dryer monitor comprising a temperature sensor that senses temperature information associated with a dryer cycle of a clothes dryer, a humidity sensor that senses humidity information associated with the dryer cycle, and a controller that determines whether one or more of a plurality of states indicative of dryer conditions associated with dryness of textiles in the dryer are satisfied based on the temperature information and the humidity information, calculates a global state score based on a number of states that are satisfied, determines whether one or more of a plurality of indicators indicative of patterns in the dryer conditions over time associated with dryness of the textiles in the dryer are satisfied based on the temperature information and the humidity information, calculate a global indicator score equal to a number of indicators that are satisfied, and generates a signal that the textiles are dry if the global state score is equal to a first predetermined global state score and the global indicator score is equal a first predetermined global indicator score.

In another example, the disclosure is directed to a computer readable medium encoded with instructions that cause one or more processors of a computing device to perform operations comprising receive temperature information associated with a dryer cycle of a clothes dryer, receive humidity information associated with the dryer cycle, determine whether one or more of a plurality of states indicative of dryer conditions associated with dryness of textiles in the dryer are satisfied based on the temperature information and the humidity information, calculate a global state score based on a number of states that are satisfied, determine whether one or more of a plurality of indicators indicative of patterns in the dryer conditions over time associated with dryness of the textiles in the dryer are satisfied based on the temperature information and the humidity information, calculate a global indicator score equal to a number of indicators that are satisfied, and signal that the textiles are dry if the global state score is equal to a first predetermined global state score and the global indicator score is equal a first predetermined global indicator score.

In another example, the disclosure is directed to a method comprising receiving temperature information associated with a dryer cycle of a clothes dryer, receiving humidity information associated with the dryer cycle, calculating an absolute humidity (AH(P)) based on the temperature information and the humidity information, calculating a reference point angle based on the absolute humidity and the temperature, the reference point angle defined as an angle made by a line from an origin to a point defined by the absolute humidity and the temperature in an AH(P) versus temperature coordinate space, and determining that textiles in the clothes dryer are dry if at least the reference point angle is less than a reference value.

In another example, the disclosure is directed to a method comprising receiving temperature information associated with a dryer cycle of a clothes dryer, receiving humidity information associated with the dryer cycle, calculating an absolute humidity (AH(P)) based on the temperature information and the humidity information, calculating a Tdry centroid distance from a point defined by the absolute humidity and the temperature to a point defined by a Tdry centroid in an AH(P) versus temperature coordinate space, wherein the Tdry centroid represents a centroid of temperature and corresponding absolute humidity data for a plurality of test dryer cycles at an empirically determined point of dryness, and determining that textiles in the clothes dryer are dry if at least the Tdry centroid distance is less than a reference value.

In another example, the disclosure is directed to a method comprising receiving temperature information associated with a dryer cycle of a clothes dryer, calculating a Tdry centroid distance from a point defined by a current temperature (TempI) and a previous temperature (TempI-1) to a point defined by a temperature phase space Tdry centroid in a TempI versus TempI-1 coordinate space, wherein the Tdry centroid represents a centroid of TempI versus TempI-1 temperature data for a plurality of test dryer cycles at an empirically determined point of dryness, and determining that textiles in the clothes dryer are dry if at least the Tdry centroid distance is less than a reference value.

In another example, the disclosure is directed to a method comprising receiving temperature information associated with a dryer cycle of a clothes dryer, receiving humidity information associated with the dryer cycle, calculating an absolute humidity (AH(P)) based on the temperature information and the humidity information, calculating a Tdry centroid distance from a point defined by a current absolute humidity (AH(P)I) and a previous absolute humidity (AH(P)I-1) to a point defined by a absolute humidity phase space Tdry centroid in an AH(P)I versus AH(P)I-1 coordinate space, wherein the absolute humidity phase space Tdry centroid represents a centroid of AH(P)I versus AH(P)I-1 absolute humidity data for a plurality of test dryer cycles at an empirically determined point of dryness, and determining that textiles in the clothes dryer are dry if at least the Tdry centroid distance is less than a reference value.

In another example, the disclosure is directed to a method comprising receiving temperature information associated with a dryer cycle of a clothes dryer, receiving humidity information associated with the dryer cycle, calculating an absolute humidity (AH(P)) based on the temperature information and the humidity information, calculating a Tdry centroid distance from a point defined by a current absolute humidity (AH(P)I) and a previous absolute humidity (AH(P)I-1) to a point defined by a absolute humidity phase space Tdry centroid in an AH(P)I versus AH(P)I-1 coordinate space, wherein the absolute humidity phase space Tdry centroid represents a centroid of AH(P)I versus AH(P)I-1 absolute humidity data for a plurality of test dryer cycles at an empirically determined point of dryness, and determining that textiles in the clothes dryer are dry if at least the Tdry centroid distance is less than a reference value.

In another example, the disclosure is directed to a method comprising receiving temperature information associated with a dryer cycle of a clothes dryer, receiving humidity information associated with the dryer cycle, calculating an absolute humidity (AH(P)) based on the temperature information and the humidity information, identifying a maximum AH(P) value for the dryer cycle, comparing subsequent AH(P) values received subsequent to the maximum AH(P) value with the maximum AH(P) value, and determining that textiles in the clothes dryer are dry if at least a specified number of the subsequent AH(P) values are decreasing from the maximum AH(P) value.

The details of one or more examples are set forth in the accompanying drawings and the description below. Other features will be apparent from the description and drawings, and from the claims.

DETAILED DESCRIPTION

Figure 1:
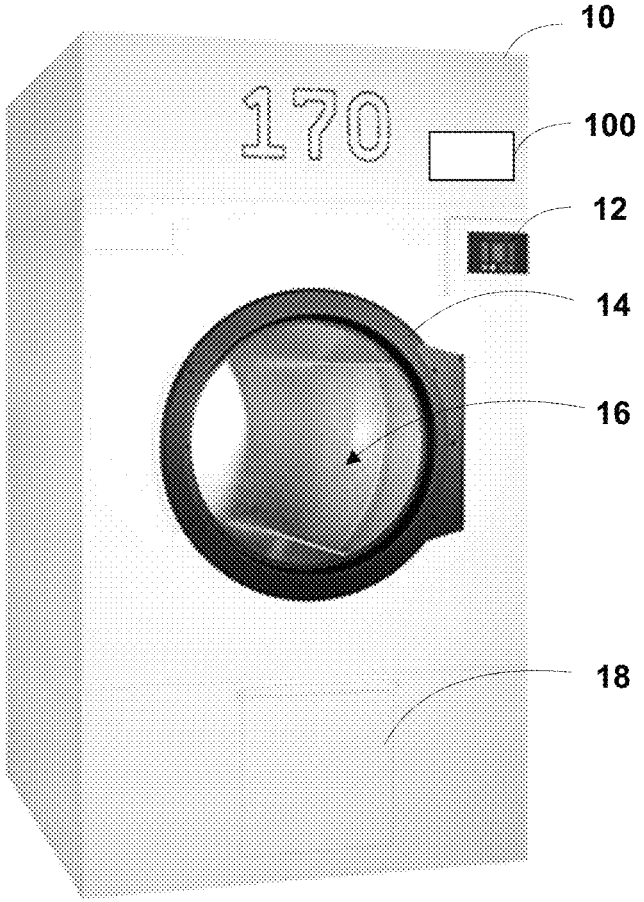
FIG. 1 is a block diagram illustrating an example clothes dryer and an example dryer monitor.

FIG. 1 is a diagram illustrating an example clothes dryer 10 and a dryer monitor 100. Dryer monitor 100 monitors at least the temperature and humidity associated with a dryer cycle to determine when textiles being dried during the dryer cycle are dry. In individual homes as well as in commercial settings, such as hotels, hospitals, laundry services or other setting in which large numbers of dryers are run through multiple cycles each day, several factors may come into play. For example, it is often the case that textiles in a dryer should be dried to the point where they are "dry" (that is, dry to the touch) but not "overdry" (that is, when the cycle continues to run past the point at which the textiles are dry to the touch, thus wasting energy and exposing the textiles to possible heat damage). To that end, dryer monitor 100 may determine and generate an indicator to notify laundry personnel when the textiles within dryer 10 are "dry." Dryer monitor 100 may also determine when the textiles in dryer 100 are "overdry." In another example, dryer monitor 100 may automatically turn off the dryer when the dry end point has been reached. As a result, dryer monitor 100 may increase operational efficiency in the sense that laundry personnel are not required to periodically check each individual dryer to determine whether the laundry is dry, nor do they need to run the dryer through additional cycles to make sure the laundry is dry. In addition, dryer monitor 100 may help to minimize the amount of time a dryer cycle continues to run after a dry end point has been achieved, thus reducing excess energy consumption and increasing linen life.

Although in FIG. 1 dryer monitor 100 is shown mounted to the front of dryer 2, it shall be understood that the dryer monitor 100 may be positioned at some other location, such as any other location on dryer 10, on a wall, in a central control area or at any other designated location. Dryer 10 includes a rotatable drying compartment 16 in which textiles to be dried are placed. A dryer control panel 12 allows a user to control operation of dryer 10. Control panel 12 may include any of the known conventional dryer controls, such as a start/stop button, a timed dry dial, a heat level selector (e.g., high, medium, low, none) and/or a fabric-type selector (e.g., heavy duty, regular, delicate). Control panel 12 may also include one or more indicia such as a cycle on indicator, a cool down indicator, a cycle done indicator, an overdry indicator, a low battery indicator, etc.

Although dryer monitor 100 will be shown and described herein with respect to a clothes dryer, it shall be understood that dryer monitor 20 may be used with any type of drying equipment, and the disclosure is not limited in this respect. Such drying equipment may include, for example, dishwashers, ware washers, car washes, or other equipment where drying of an object or objects is required. In addition, dryer monitor 100 may be used to monitor and/or alarm to temperature, humidity or other environmental conditions in any application where such monitoring is required or desired.

Figure 2:
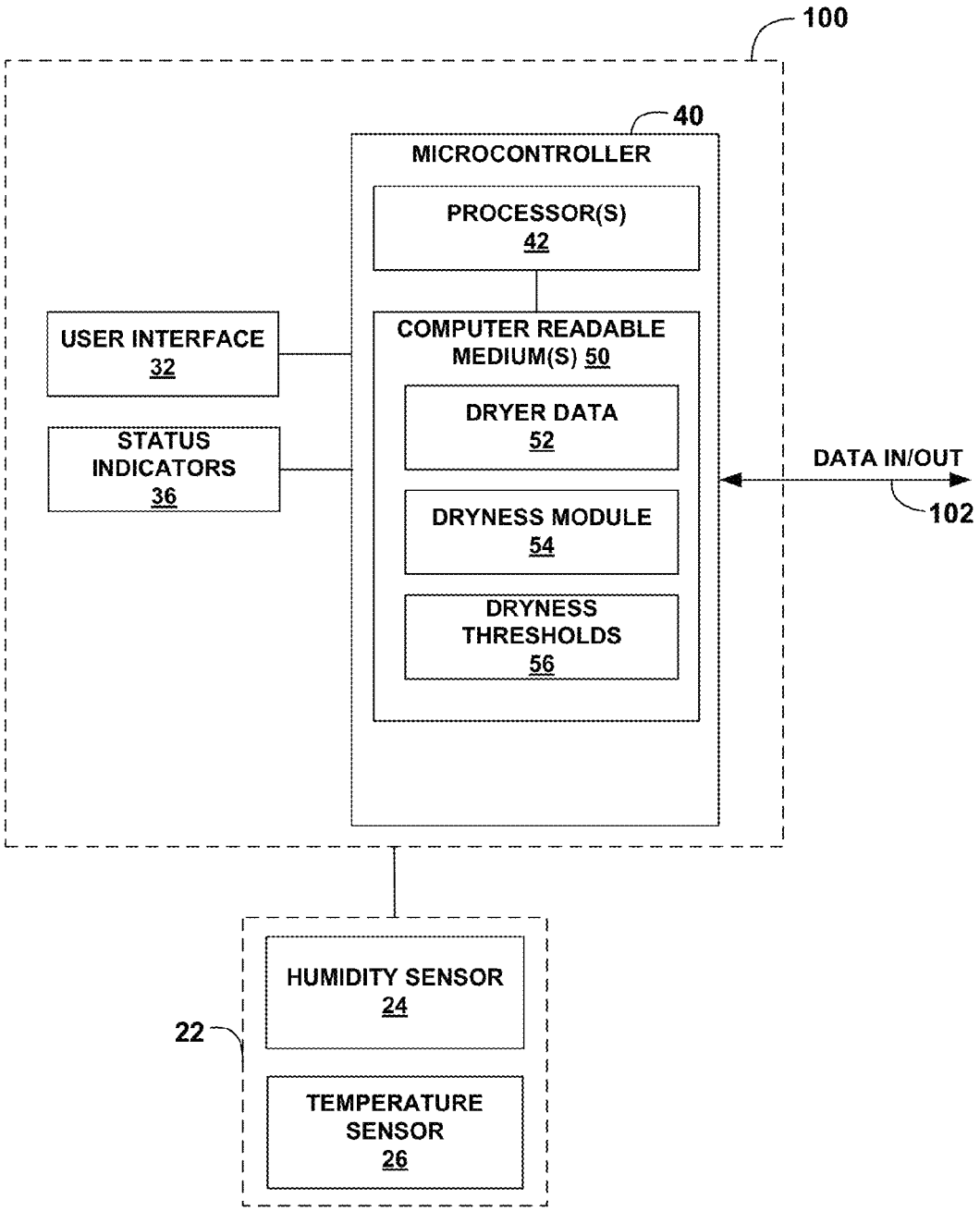
FIG. 2 is a block diagram illustrating the electronic components of an example dryer monitor.

FIG. 2 is a block diagram illustrating the electronic components of an example dryer monitor 100. In this example, dryer monitor 100 includes an embedded microcontroller 40 including at least one processor 42 and a memory (illustrated generally as computer readable medium 50) that stores programs and/or data associated with operation of the dryer monitor 100. Dryer monitor 100 may also include a user interface 32 and one or more status indicators 36. Controller 40 monitors the outputs of one or more sensor(s) 22 and may manage communication with one or more local or remote computers, laptops, cell phones, PDAs, etc., via one or more input/out (I/O) connections indicated generally by line 102.

Dryer monitor 100 receives dryer information concerning the operation and/or status of the dryer from one or more sensors 22. Sensor(s) 22 may include, for example, humidity sensor(s) 24 and temperature sensor(s) 26. Sensors 22 may also include moisture content sensors, dryer on/off sensors, or any other sensors that may detect relevant data concerning operation of the dryer, conditions within dryer or condition of the textiles within the dryer. Sensors 22 may be located at any appropriate position with respect to the dryer where it is convenient or where it is best suited to measure the dryer information at issue. For example, sensors 22 may be located inside and/or outside the drying compartment 16 of the dryer, in or near an exhaust compartment 18, or in any other appropriate location.

The sensed dryer information received from any of sensors 24 and 26, and/or any other sensors that may obtain relevant information concerning operation of the dryer, may be stored by dryer monitor microcontroller as dryer data 52. In this example, "dryer data" includes, for example, temperature information and humidity information (such as relative and/or absolute humidity information). The dryer data may also include dryer on/off information, dryer rotation information, etc.

A dryness module 54 contains the software programming that analyzes the dryer data to determine whether textiles in the dryer are dry. Dryness thresholds 56 that may include default dryness threshold settings that are programmed into dryer monitor 100 at the time of manufacture. Alternatively, dryness thresholds 56 may be configured with customized settings by a service technician at the time of installation. Customized dryer thresholds 56 may also be configured or downloaded remotely at some later time. For example, customized dryness thresholds may be devised for specific accounts, geographical locations, etc., if desired.

Dryer monitor 100 may generate one or more electronic communications concerning dryness of the textiles in the dryer, status of the dryer or various fault conditions and transmit the electronic communication to laundry personnel, a service technician, or monitoring service. The alerts may be transmitted either wired or wirelessly. For example, the alerts may be transmitted via e-mail, text message, cell phone, or other means of electronic communication. In addition, dryer monitor 100 may transmit the so-called "dryer data," including one or more of temperature data, humidity data, and/or other data monitored or generated by dryer monitor to a local or remote computer for analysis and reporting.

Dryer monitor 100 may be used with any drying equipment. For example, dryer monitor 100 may be an auxiliary device that may be added to existing dryers that are not equipped with dryness sensing capability. As such, dryer monitor 100 may include its own power supply, such as 9 V, AA, or other battery. As another example, dryer monitor 100 may be integrated into a dryer at the time of manufacture, or integrally connected to the dryer power supply and/or other component(s) at a later time.

As mentioned above, dryness module 54 includes a software algorithm that, when executed by processor(s) 42 or by some other processor or computer, analyzes the dryer data to determine whether textiles in the dryer are dry. More specifically, execution of the algorithm stored in dryness module 54 permits dryer monitor 100 to monitor and analyze dryer temperature and relatively humidity information and to detect and/or signal when the textiles are dry based on the analysis.

The raw dryer data includes, for example, dryer temperature information received from one or more temperature sensors, such as temperature sensor 26, and dryer humidity information received from one or more humidity sensors, such as humidity sensor 24. The sensors 24, 26 may be placed, for example, in the dryer vent, or at any other location within or associated with the dryer at which relevant dryer data may be obtained. In the example described herein, the humidity data received from humidity sensor 24 is relative humidity data. The absolute humidity may then be calculated from the relative humidity and temperature data. However, it shall be understood that other types of humidity data, such as absolute humidity or specific humidity, may be directly measured by humidity sensor 24 in addition to or alternatively to the relatively humidity data.

Analysis of field test dryer data has led to development of the present dryer monitor algorithm. During the field tests, temperature and humidity information for each of a plurality of example test dryer cycles was obtained. For each of the plurality of example test dryer cycles, the time at which the textiles in the dryer were manually determined to be dry was also identified. This time is referred to herein as the dry end point, or "Tdry." In the example dryer cycles shown and described herein, the temperature and humidity data was sampled at approximately 1-minute sample intervals. However, it shall be understood that the temperature and humidity data may be sampled more frequently, less frequently, at any appropriate interval, or at specified times, and that the disclosure is not limited in this respect.

Specifically, analysis of the example field test dryer cycle data led to identification of the following features of the dryer cycle data that, either alone or in various combinations, may be indicative of dryness of textiles in a dryer:

(1) one or more states that may be indicative of dryer conditions that may be associated with dryness of textiles in the dryer;

(2) one or more indicators (data patterns) that may be indicative of the existence of patterns in the dryer conditions over time that may be associated with dryness of the textiles in the dryer; and/or (3) weighting scheme(s) that may be applied to one or more of the states and/or one or more of the indicators in certain situations.

For example, the states may include one or more of the following:

(1) Time. For this state to be satisfied, the dryer cycle must have run for a minimum amount of time (e.g., a minimum number of minutes or other predetermined time period).

(2) Temperature. For this state to be satisfied, the temperature must be higher than the temperature at the start of the cycle. In some examples, in order to determine that a load is dry, the temperature must be at least a predetermined amount higher than the temperature at the start of the dryer cycle.

(3) Relative humidity (RH %). For this state to be satisfied, the RH % must be below an RH % reference value.

(4) Absolute humidity (AH(P)). For this state to be satisfied, the AH(P) must be below an AH(P) reference value.

Figure 3:
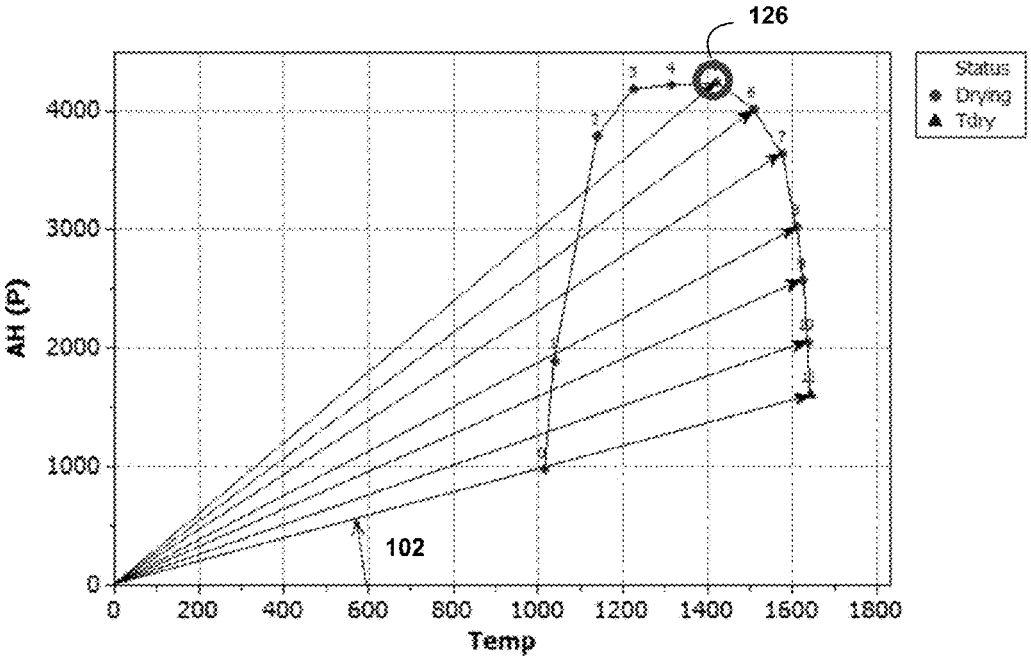
FIG. 3 is a graph of AH(P) versus temperature for one example dryer cycle.

(5) Reference point angle (RPA). For this state to be satisfied, the reference point angle must be below a RPA reference value. In this example, the reference point angle may be defined as the angle made with the x-axis by a line connecting the origin and the dryer data point in the AH(P) vs. Temperature space. FIG. 3 is a graph of AH(P) versus temperature for one example dryer cycle. The example data was taken at 1-minute sampling intervals. The reference point angle 102 for the example dryer data point at minute 11 is illustrated on the graph. Similar reference angles may be determined for each of the data points. It shall be understood that although in the example the reference point angle is measured with respect to the x-axis and with respect to a line connecting with the origin, the reference point angle may be measured with respect to any fixed axis or with respect to a line connecting with any appropriate point, and that the disclosure is not limited in this respect.

Figure 4:
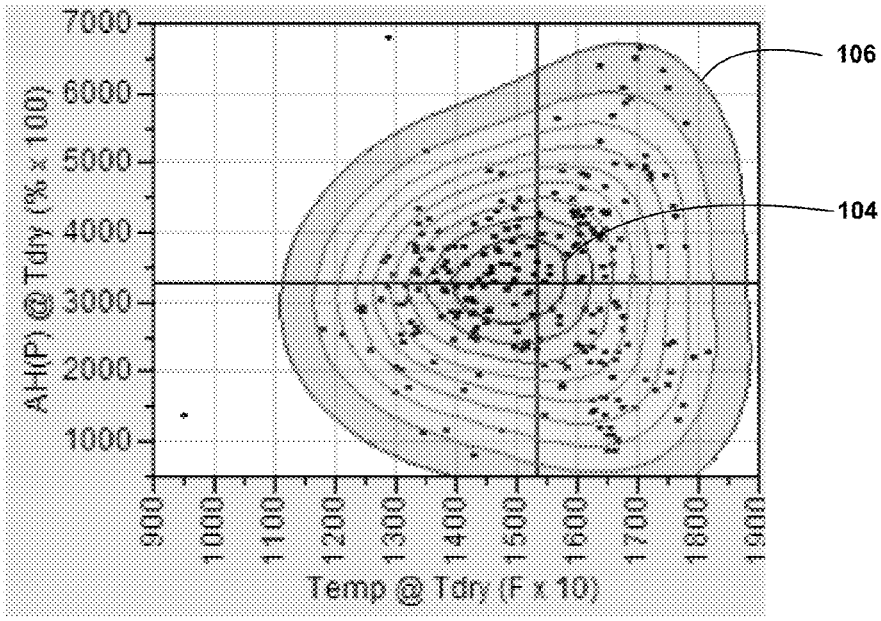
FIG. 4 is a graph of AH(P) versus temperature for several example dryer cycles at the Tdry point (the time at which a technician manually determined that the textiles were dry) for each example dryer cycle.
Figure 5:
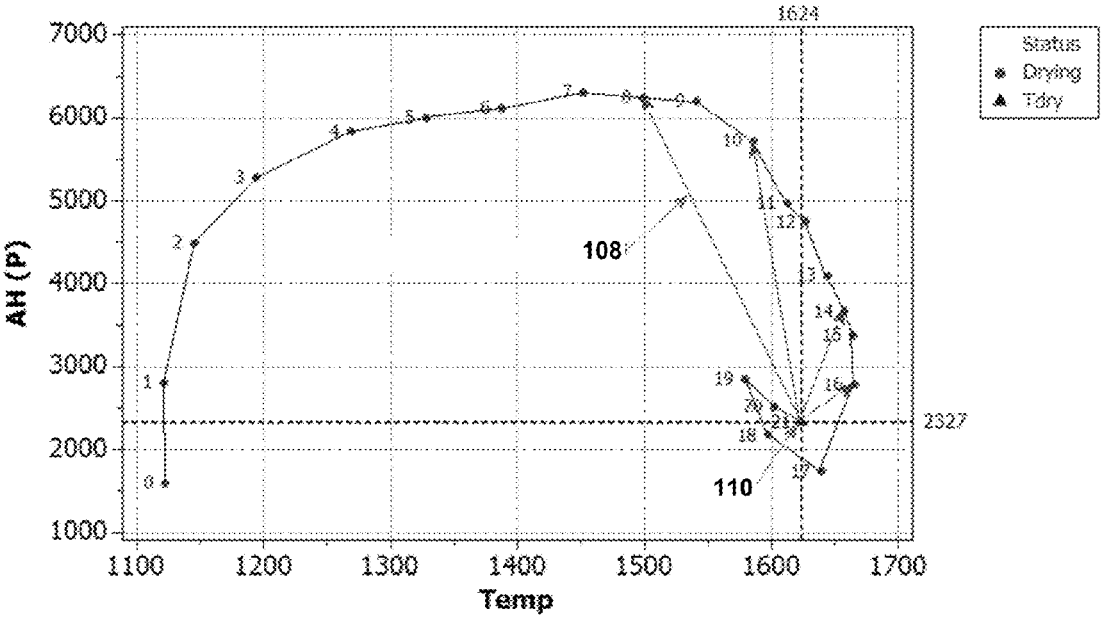
FIG. 5 shows an example of the distances from the centroid measured at each minute of an example dryer cycle.

(6) Distance from Tdry Centroid. For this state to be satisfied, the Tdry centroid distance in the AH(P) vs. Temperature space must be below a reference value. FIG. 4 is a graph of AH(P) versus temperature for several example dryer cycles at the Tdry point for each example dryer cycle. The AH(P) versus Temperature space centroid (identified by reference numeral 104 in this example) value may be predetermined based on available field test data and programmed into the dryer monitor algorithm. The centroid may be calculated based on known centroid calculation equations. In this example, the Tdry centroid represents a centroid of temperature and corresponding absolute humidity data for a plurality of test dryer cycles at an empirically determined point of dryness. The distance of each 1-minute sample point from the centroid may be calculated and compared to the reference Tdry centroid distance (identified by reference numeral 106 in this example) to determine whether this state is satisfied. FIG. 5 shows an example of the distances from the centroid (indicated by reference numeral 110 in this example) measured at each minute of an example dryer cycle. Reference numeral 108 illustrates the distance from centroid for minute 8 of the example dryer cycle.

Figure 6:
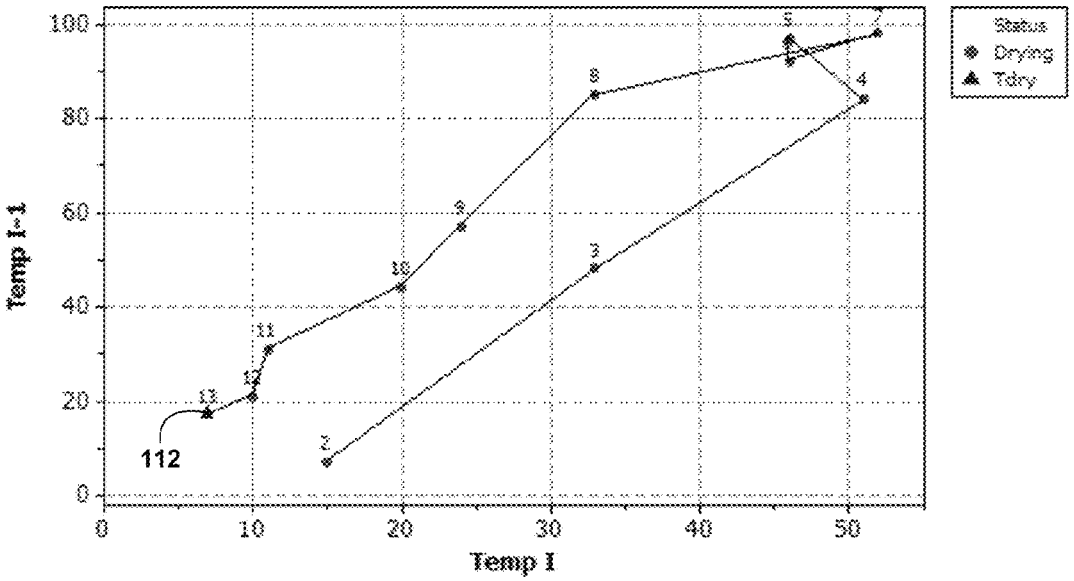
FIG. 6 shows an example Poincare plot for a single dryer cycle.
Figure 7:
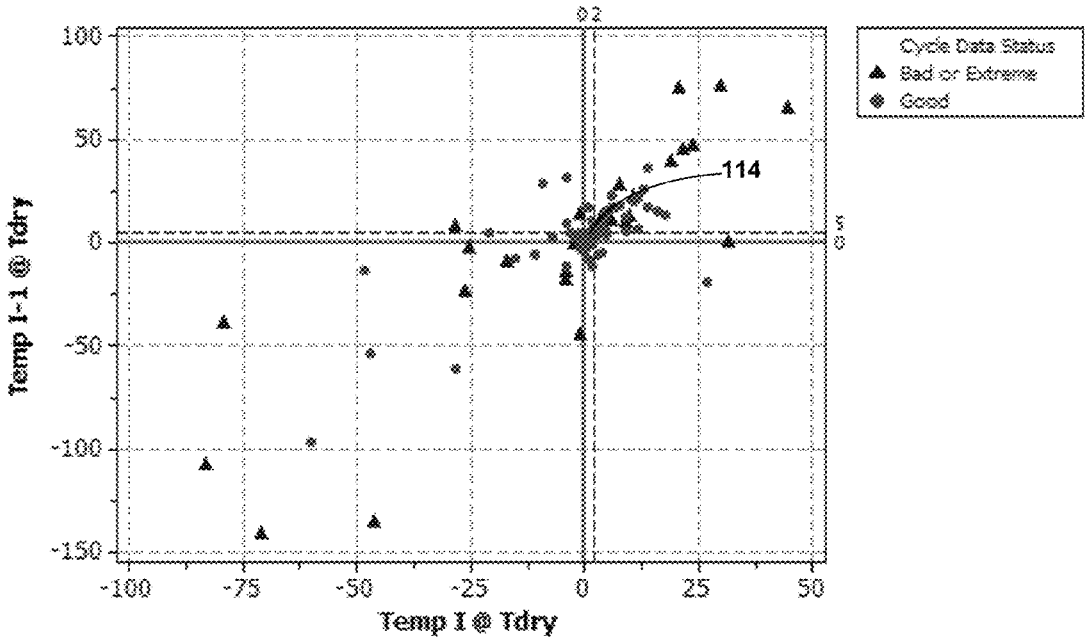
FIG. 7 shows a plot of Temp I and Temp I-1 values at Tdry for example dryer cycle data.

(7) Temperature Phase Space Tdry Centroid Distance. For this state to be satisifed, the example dryer cycle data to Tdry centroid distance in the temperature phase space (TempI-1 at Tdry versus TempI at Tdry) must be below a reference value. FIG. 6 is a Poincare plot of (TempI-1 versus TempI) at 1-minute sample intervals for an example dryer cycle. Tdry is identified by reference numeral 112 in this example. FIG. 7 is a plot of (TempI-1 at Tdry versus TempI at Tdry) for an example plurality of dryer cycles. The temperature phase space centroid (identified by reference numeral 114 in this example) value may be predetermined based on available field test data and programmed into the dryer monitor algorithm, rather than being calculated as part of the dryness algorithm itself.

Figure 8:
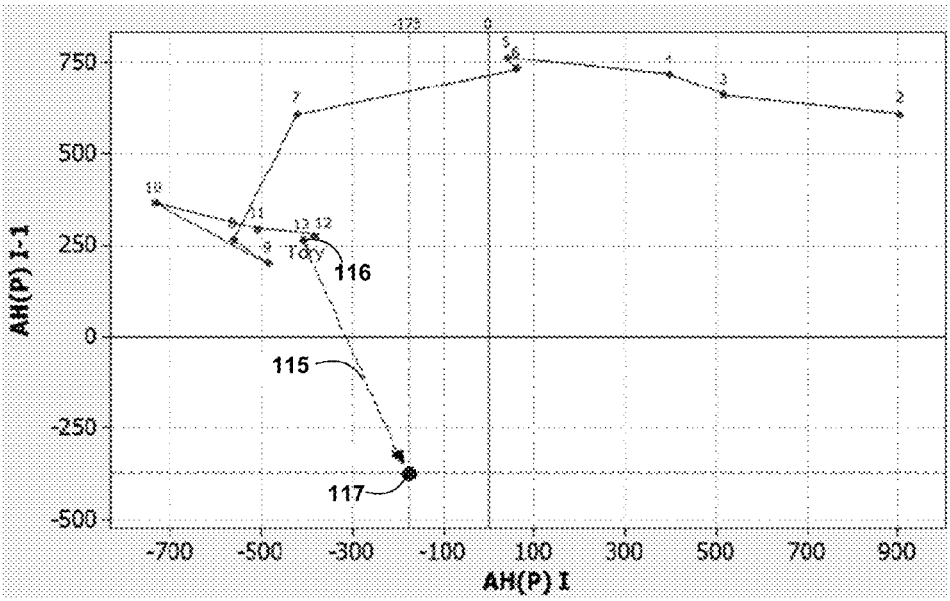
FIG. 8 is a plot of AH(P)I-1 versus AH(P)I for an example dryer cycle.

(8) AH(P) Phase Space Tdry Centroid Distance. For this state to be satisfied, the example dryer cycle data to Tdry centroid distance in the AH(P) phase space when a load is dry must be below a reference value. FIG. 8 is a plot of AH(P)I-1 at Tdry versus AH(P)I at Tdry (indicated by reference numeral 116) for an example dryer cycle. The AH(P) phase space centroid (identified by reference numeral 117 in this example) value may be predetermined based on available field test data and programmed into the dryer monitor algorithm, rather than being calculated as part of the dryness algorithm itself. In this example, the Tdry centroid represents a centroid of TempI versus TempI-1 temperature data for a plurality of test dryer cycles at an empirically determined point of dryness. The Tdry Centoid Distance is indicated by reference numeral 115.

A binary value for each state may be determined at each sample interval. For each state, if the state criterion is met, the state may be scored a 1. If the state criterion is not met, the state may be scored a 0. The dryer monitor may also determine a global state score indicative of the total number of states that are satisfied. For example, the global state score may be calculated as a sum of the binary values for each of the one or more states. For example, if all 8 states must be present for a load to be dry, the global state score must be 8 in order for the dryer monitor to determine the load is dry. A global state score of less than 8 in this example would mean that not all of the states have been satisfied, and that a determination of dryness cannot be made.

Figure 9:
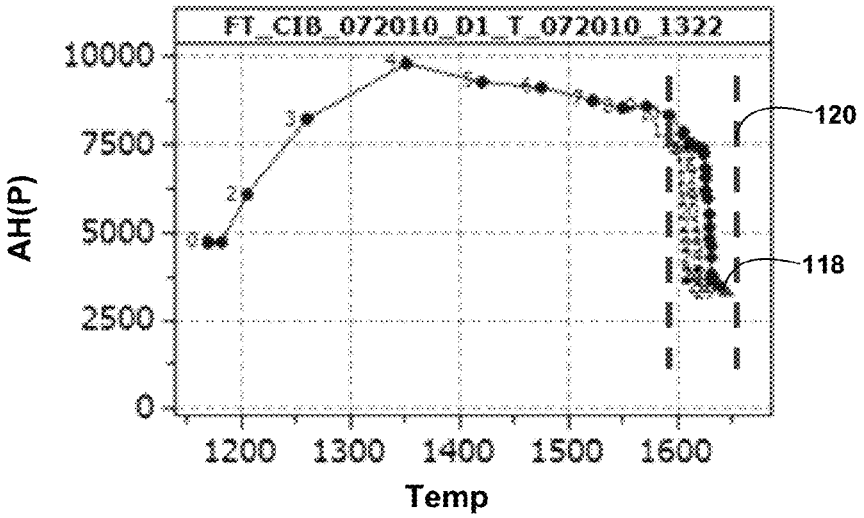
FIG. 9 is a graph of AH(P) versus temperature for one example dryer cycle.

In some examples, one or more of a plurality of indicators must also be met for a load to be dry. As mentioned above, the indicators seek to identify patterns in the dryer conditions over time that may be associated with dryness of the textiles in the dryer. The indicators may include, for example, one or more of the following:

(1) Temperature steady. For this indicator to be satisfied, the temperature varies within a specified temperature range for at least a specified number of sequential data points before the load is dry. An example is illustrated with respect to FIG. 9, which is a graph of AH(P) versus temperature for one example dryer cycle. The example data was taken at 1 minute intervals. The data of FIG. 9 illustrates that the temperature before Tdry (indicated in this example by reference numeral 118) varies within a predetermined temperature range (indicated in this example by reference numeral 120) for at least a specified number of data points for this indicator to be satisfied.

(2) AH(P) decreasing from maximum value. For this indicator to be satisfied, AH(P) must be decreasing for at least a specified number of sequential data points. Referring again to FIG. 3, the data illustrates that AH(P) begins decreasing from its maximum value (indicated in this example by reference numeral 126) at time t=6 and for each data point after time t=6. The decrease in AH(P) from the maximum must be maintained for at least a specified number of sequential data points for this indicator to be satisfied.

(3) AH(P) decreasing from recent values. For this indicator to be satisfied, AH(P) must be decreasing from recent values for at least a specified number of sequential data points. Referring again to FIG. 3, the data illustrates that AH(P) is decreasing from the previous value of AH(P) starting at time t=6. This decrease in AH(P) from recent values must be maintained for at least a specified number of sequential data points in order for this indicator to be satisfied.

Figure 10:
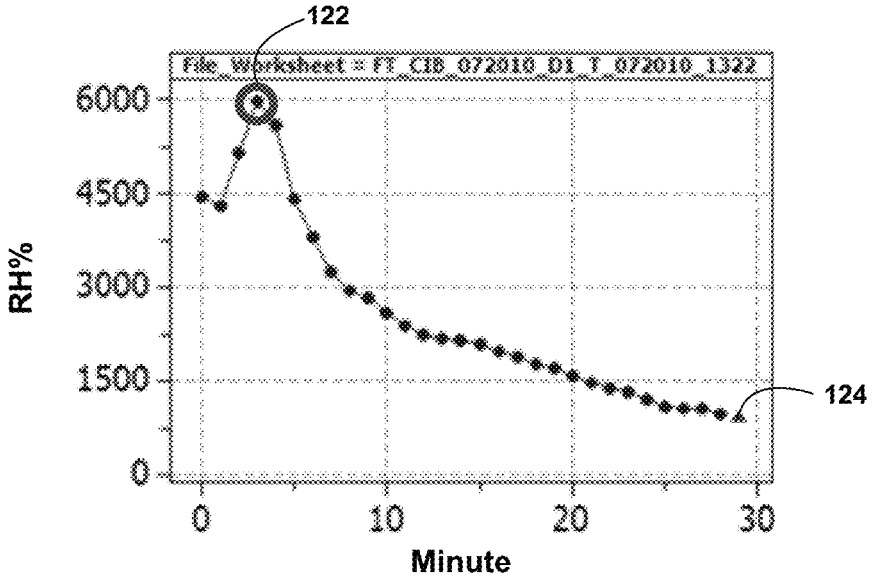
FIG. 10 is a graph of RH % versus temperature for one example dryer cycle.

(4) RH % decreasing from maximum value. For this indicator to be satisfied, RH % must be decreasing for at least a specified number of sequential data points. An example is illustrated with respect to FIG. 10, which is a graph of RH % versus time for one example dryer cycle. The data of FIG. 10 illustrates that RH % begins decreasing from the maximum (indicated in this example by reference numeral 124) at time t=4. This decrease must be maintained for at least a specified number of sequential data points in order for this indicator to be satisfied.

(5) Reference point angle decreasing. For this indicator to be satisfied, the reference angle must be decreasing from recent values for at least a specified number of sequential data points. Referring again to FIG. 3, the data illustrates that the reference point angle is decreasing from the previous value starting at time t=6. This decrease in reference point angle from recent values must be maintained for at least a specified number of sequential data points in order for this indicator to be satisfied.

A binary value for each indicator may be determined at each interval. For each indicator, if the indicator criterion is met, the indicator may be scored a 1. If the indicator criterion is not met, the indicator may be scored a 0. The dryer monitor may also determine a global indicator score indicative of the number of indicators that are satisfied. For example, the global indicator score may be determined as a sum of the binary values for each of the one or more indicators. For example, if all 5 indicators must be present for a load to be dry, the global indicator score at Tdry would be 5. A global indicator score of less than 5 in this example would mean that not all of the indicators have been satisfied, and that the dryer monitor may not make a determination of dryness.

As mentioned herein, dryer monitor 100 receives temperature and humidity information associated with operation of the dryer, and determines whether textiles in the dryer are dry based on the temperature and humidity information. Again, the sensors may sense relative humidity, absolute humidity, or other type of humidity information. The sensors may also sense other data which may be used to calculate relative or absolute humidity. For purposes of the present example, the humidity sensor(s) sense relative humidity. Absolute humidity may then be calculated based on the sensed temperature and relative humidity information.

The inputs into the algorithm include, in the detailed example described herein, temperature, relative humidity (RH %) and/or absolute humidity (AH(P)). The temperature and relatively humidity information may be obtained from sensors associated with the dryer, and the absolute humidity may be calculated based on the temperature and the relatively humidity information. Specifically, in this example, the inputs to the algorithm may include, for example, one or more of the following variables taken at a predetermined sampling rate (such as one sample per second, 5 seconds, 10 seconds, 1 minute, etc.) during the dryer cycle. It shall be understood by those of skill in the art that other sampling rates, equations, and multipliers may be used and that the disclosure is not limited in this respect:

(1) Temperature T: Units are degrees F. multiplied by 10;

(2) Relative humidity RH %: Units are percent multiplied by 100;

(3) Absolute humidity AH(P): Units are Pascals, calculated using values (1) and (2) using an equation known to those of skill in the art. One example is provided in Don W. Green, D. W., Robert H. Perry, et al., Perry's Chemical Engineers' Handbook (8th Edition), McGraw-Hill (2008), pp. 12.5.

The inputs and calculated values may be indexed from time zero defined as the start of the dryer cycle. The start of the dryer cycle may be determined, for example, using a sensor mounted on the dryer motor that senses when the motor is on, or may be received from the dryer controller, etc. In this example, for all calculations, the values of the three inputs were obtained at approximately 1-minute intervals starting at time zero. Example data for the first 10 minutes of an example dryer cycle is shown in Table 1.

TABLE 1

Example Inputs at 1-minute intervals.

| Minute (approx.) | Temp | RH % | AH (P) |
|---|---|---|---|
| 0 | 1218 | 1094 | 1343.6 |
| 1 | 1261 | 2321 | 3206.3 |
| 2 | 1354 | 2838 | 5022.7 |
| 3 | 1458 | 2068 | 4778.9 |
| 4 | 1527 | 1935 | 5306.8 |
| 5 | 1561 | 1804 | 5374.5 |
| 6 | 1565 | 1627 | 4894.3 |
| 7 | 1572 | 1566 | 4791.0 |
| 8 | 1577 | 1532 | 4743.8 |
| 9 | 1585 | 1545 | 4876.8 |
| 10 | 1594 | 1428 | 4605.7 |

As discussed above, in the specific example described herein, the dryer data must satisfy at least one of the one or more states before a dryness determination can be made. The states are binary variables with 0 indicating the state has not been met and 1 indicating the state is met. Further details concerning each of the one or more states are described in more detail below.

(1) Time. As described above, a minimum number of minutes ($\text{Minute}_{tmin}$) of the dryer cycle must have elapsed for a load to be dry. For example, at each minute update interval, the Time state may be scored a 0 if the time is less than a predetermined number of minutes, and 1 if the time is greater than a predetermined number of minutes. In one example, the predetermined number of minutes was determined, based on empirical data, to be 8 minutes. This means that no dryer cycle was less than 9 minutes when Tdry was obtained (in the example, Tdry is the elapsed number of minutes when a human tester manually determined that the textiles were dry). It shall be understood, however, that this value need not be 8 minutes, and that the value may be varied, if desired, depending upon the desired accuracy in the dryness determination. In addition, the time need not be expressed in minutes, but may be expressed as a function of some other time interval, if desired.

(2) Temperature. As described above, the temperature when the textiles in the dryer are dry will generally be higher than the temperature at the start of the dryer cycle. In this example, the temperature at any particular time t may be compared to the so-called average temperature at time t=3 ($\text{Minute}_{t\times3}$). The average temperature at $\text{Minute}_{t=3}$ is the average temperature for Minutes 1, 2 & 3. For example, at each minute update interval ($\text{Minute}_{t\times3}$), the Temperature state may be scored a binary zero if the average temperature for $Minute_t$ and $Minute_{t-1}$ is less than or equal to the average temperature at $Minute_{t=3}$, and may be scored a binary 1 otherwise.

As another example, the temperature when the textiles in the dryer are dry must be at least a predetermined amount higher than the temperature at the start of the dryer cycle. In one example, based on empirical data, the temperature when the textiles in the dryer are dry must be at least 10° F. higher than the temperature at the start (or, e.g., the average of the first few minutes) of the dryer cycle.

Although specific examples have been given, it shall be understood that there may be other ways of determining whether the Temperature state is met, and that the disclosure is not limited in this respect.

(3) RH %. As described above, the RH % when a load is dry must be below a reference value. At each minute update interval, the RH % state may be scored a 0 if the RH % value is greater than or equal to a predetermined reference value, $RH\ \%_{ref}$, and may be scored a 1 otherwise. In one example, based on empirical data, $RH\ \%_{ref}$ may be in the range of 2000-2500. However, it shall be understood that these are but some examples of a suitable $RH\ \%_{ref}$ range, that other values of $RH\ \%_{ref}$ may be used, and that the disclosure is not limited in this respect.

(4) Absolute humidity (AH(P)). As described above, the AH(P) when a load is dry must be below a reference value. At each minute update interval, the AH(P) state may be scored 0 if the AH(P) value is greater than or equal to a predetermined reference value, $AH(P)_{max}$, and may be scored a 1 otherwise. In one example, based on empirical data, $AH(P)_{ref}$ may be in the range of 3500-6000. As another example, $AH(P)_{ref}$ may be a predetermined percentage (e.g., 95% or some other appropriate percentage) of the maximum AH(P) for the dryer cycle, or may be set at a predetermined percentage (e.g., 95% or some other appropriate percentage) of the average of the maximum AH(P) for a plurality of dryer cycles. However, it shall be understood that these are but some examples of a suitable $AH(P)_{max}$ range, that other values of $AH(P)_{ref}$ may be used, and that the disclosure is not limited in this respect.

(5) Reference point angle. As described above, the Reference Point Angle when a load is dry must be below a reference value. At each minute update interval, the Reference Point Angle may be scored a 0 if the value is greater than a predetermined reference value ($RPA_{ref}$), and may be scored a 1 otherwise. Referring again to the example illustrated in FIG. 3, the reference point is the point in two-dimensional space (x=Temp, y=AH(P)) where Temp and AH(P) are both zero (the origin) It shall be understood, however, that the reference point angle need not be measured with respect to the origin, and that the disclosure is not limited in this respect. An example reference point angle 102 for time interval t=11 is shown in FIG. 3. For example, the following equation may be used to calculate the reference point angle:

$$\text{Reference point angle} = \text{Degrees}(A\ \text{TAN}\ 2(\text{Temp},(AH(P)/10))).$$

In one example, based on empirical data, $RPA_{ref}$ may be in the range of 15-20°. However, it shall be understood that this is but one example of a suitable $RPA_{ref}$ range, that other values of $RPA_{ref}$ may be used, and that the disclosure is not limited in this respect.

(6) Cartesian Distance from Tdry Centroid. As described above, the Cartesian Distance from Tdry Centroid in the AH(P) vs. Temperature space when a load is dry must be below a reference value. At each minute update interval, the current sample AH(P) and Temperature data values are used to calculate the Tdry Centroid Cartesian Distance, or the distance from Tdry Centroid. This distance may be scored a 0 if the calculated distance is greater than a predetermined reference value ($CD_{reftemp}$), and may be scored a 1 otherwise. In one example, based on empirical data, $CD_{reftemp}$ may be in the range of 1700-3000. However, it shall be understood that this is but one example of a suitable $CD_{reftemp}$ range, that other values of $CD_{reftemp}$ may be used, and that the disclosure is not limited in this respect.

The Tdry centroid value(s) may be predetermined based on empirical data and programmed into the algorithm, rather than calculated as part of the algorithm itself. The Tdry centroid is the center of all available field data Tdry points (that is, the point at which a technician determined that the load was dry) when plotted in two-dimensional space (x=Temp, y=AH(P)). In the example shown in FIG. 4, the centroid coordinates are Temp=1523 and AH(P)=3287. In that example, therefore, the predetermined centroid coordinates may be Temp=1624 and AH(P)=2319. However, it shall be understood that this is but one example of a suitable centroid coordinates, that other values of centroid coordinates may be used, and that the disclosure is not limited in this respect.

The Cartesian Distance to Tdry Centroid in the AH(P) vs. Temperature phase space may be calculated using the following equation. Examples of the Cartesian Distances for time intervals 8-21 are shown in FIG. 5.

$$\text{Cartesian Distance}_{AH(P)} = \sqrt{(T_{\text{TdryC}} - \text{T}_t)^2 + (AH_{\text{TdryC}} - \text{AH}_t)^2}$$

where $T_{TdryC}$=Temp at Tdry centroid (e.g., 1624)
$T_t$=Temp at minute t
$AH_{TdryC}$=AH(*P*) at Tdry centroid, and
$AH_t$=AH(P) at minute t.

(7) Temperature Phase Space Tdry Centroid Cartesian Distance. The distance from Tdry centroid in the temperature phase space (TempI-1 at Tdry versus TempI at Tdry) for a load to be dry must be below a reference value. The distance for the data values at each sample period are calculated from the medians for the Temp I and Temp I-1 intervals from all available cycle data. This state is based on the Poincare plot of nonlinear dynamic systems time-series data with Temp I being the interval or difference between the temperature at minute, and the temperature at $minute_{i-1}$. TempI-1 is the interval or difference between the temperature at minute, and the temperature at $minute_{i-2}$. An example Poincare plot for a single dryer cycle is shown in FIG. 6. As the cycle approaches Tdry (indicated in this example by reference numeral 112) the values approach the origin (0,0) along a substantially diagonal vector. Values by plot points show the number of elapsed minutes from dryer start. FIG. 7 shows a plot of Temp I-1 vs. Temp I values at Tdry (indicated by reference numeral 114) for example dryer cycle data. The Centroid coordinates in this example are Temp(I)=2 and Temp(I-1)=4.

The Cartesian Distance in the temperature phase space at each minute update interval from the 2D (Temp I-1 versus Temp I) Poincare plot coordinates to the centroid of all available such values at Tdry may be calculated using the following equation. Although in this example the Cartesian Distance is determined from the centroid, the Cartesian Distance may also be determined from the origin or from another appropriate point in the temperature phase space.

$$\text{Cartesian Distance}_{TempPhase} = \sqrt{(T_{\text{IC}} - \text{TI}_t)^2 + (T_{\text{I-1C}} - T(I-1)^t)^2}$$

where $T_{IC}$=Temp I centroid
$TI_t$=Temp I value at minute
$tT_{I-1C}$=Temp I-1 centroid, and
$T(I\text{-}1)_t$=Temp I-1 value at minute t.

For example, at each minute update interval, the Temperature Phase Space Centroid Cartesian Distance state may be scored a 1 if the calculated value is less than a predetermined reference value ($CD_{reftempphase}$) and a binary zero otherwise. In one example, based on empirical data, $CD_{reftempphase}$ may be less than about 80. However, it shall be understood that this is but one example of a suitable $CD_{reftempphase}$, that other values of $CD_{reftempphase}$ may be used, and that the disclosure is not limited in this respect. Also, based on example empirical data, the centroid coordinates in the temperature phase space were found to be Temp I=2, and Temp I-1=5. However, it shall be understood that this is but one example of suitable centroid coordinates in the temperature phase space, that other values of the centroid coordinates in the temperature phase space may be used, and that the disclosure is not limited in this respect.

(8) AH(P) Phase Space Tdry Centroid Distance. The distance from Tdry centroid in the AH(P) phase space when a load is dry must be less than a predetermined reference value. This state is similar to state 7, but for AH(P). This state is based on the Poincare' plot of nonlinear dynamic systems time-series data with AH(P) I being the interval or difference between the AH(P) at minute, and the AH(P) at $minute_{i-1}$. AH(P) I-1 is the interval or difference between the AH(P) at minute, and the AH(P) at $minute_{i-2}$.

The following equation may be used to calculate the Cartesian Distance at each minute update interval from the 2D (AH(P) I versus AH(P) I-1 plot coordinates to the centroid of all available such values at Tdry may be calculated.

$$\text{Cartesian Distance}_{AH(P)Phase}=\sqrt{(AH(P)_{IC}-AH(P)I_1)^2+(AH(P)_{I\text{-}1C}-AH(P)(I-1)_t)^2}$$

where $AH(P)_{IC}$=AH(P)I centroid $AH(P)I_t$=AH(P)I value at minute $AH(P)_{I\text{-}1C}$=AH(P)I-1 centroid, and $AH(P)_t=(I\text{-}1)_t$=AH(P) I-1 value at minute t.

A plot of the AH(P)I-1 and AH(P) I values at Tdry for example dryer cycle data is shown in FIG. 8. The plot points fall substantially along a diagonal (approximately 45-degrees in this example) with the trajectories starting in the upper right and working their ways towards the origin (0,0) as Tdry approaches. In some examples, the centroid of the 2D values may be used to calculate the Cartesian Distance in the AH(P) phase space. However, it shall be understood that the Cartesian Distance may also be calculated from the origin, or from any other appropriate point in the AH(P) phase space.

For example, at each minute update interval, the Cartesian Distance from Centroid in the AH(P) Phase Space state may be scored a 0 if the calculated distance is greater than a predetermined reference value ($CD_{refAH(P)phase}$) and may be scored a binary 1 otherwise. In one example, based on empirical data, $CD_{refAH(P)phase}$) may be less than about 2200. In this example, the centroid values were found to be AH(P)I=−174.8, and AH(P)I-1=−372.3. However, it shall be understood that this is but one example of a suitable $CD_{refAH(P)phase}$, that other values of $CD_{refAH(P)phase}$ may be used, and that the disclosure is not limited in this respect. In addition, it shall be understood that this is but one example of suitable centroid coordinates in the temperature phase space, that other values of the centroid coordinates in the temperature phase space may be used, and that the disclosure is not limited in this respect.

As described above, a global state score may be determined. For example, the global state score may be calculated as the sum of the binary values for each of the one or more states. As another example, the global state score may calculated as the sum of the binary values for one or more selected ones of the states. The global state score may be updated each minute (or other time interval at which data is sampled). For example, if all 8 states must be present for a load to be dry, the global state score at Tdry would be 8. A global state score of less than 8 in this example would mean that not all of the states have been satisfied, and that therefore the load cannot be dry. In this example, the global state score has persistence so once it has reached the maximum global state score, it will remain at the maximum global state score for the remainder of the cycle. For example, if all 8 states must be met in order for a cycle to be dry, the maximum state score is 8, and once the global state score reaches 8 in a cycle, it will remain at 8 for the remainder of the cycle. As another example, if only 6 of the states must be present for a load to be dry, a global state score of less than 6 would mean that all of the required states have not been satisfied, and that the dryer monitor may not determine that the load is dry. In some examples, the dryer monitor must determine that at least one of the states are met in order to make a determination of dryness.

In another example, the dryer data may be required to satisfy one or more indicators (patterns in the data) before a dryness may be determined. The indicators may be binary variables with 0 meaning that the indicator has not been met and 1 meaning that the indicator is met. In some examples, the dryer monitor must determine that at least one of the indicators are met in order to make a determination of dryness. Further details concerning each of the one or more indicators are described below.

(1) Temperature steady. In order for this indicator to be met, the temperature at Tdry (indicated, for example, by reference numeral 118 in FIG. 9) may not vary outside of a predetermined temperature range (indicated, for example, in FIG. 9 by reference numeral 120) for at least a specified number of data points. In one example, based on empirical data, the temperature range may be between ±60° to ±90° of the average temperature of the previous four minutes. In this example, at each minute update interval the Temp steady indicator may be scored a 1 if the average Temp at the current minute is within the specified range of the average of the previous four minutes, and may be scored a 0 otherwise. The temperature is "steady" when the cycle enters the temp oscillating period once the temp set-point of the particular dryer has been reached—this is caused by the gas burners turning on and off as the controller attempts to keep the dryer at the temperature set-point (that is, the temperature set-point as determined by the dryer setting, such as high, medium, low, regular, delicate, or similar temperature settings on a dryer). The temperature set points may vary across machine types, manufacturer, geographical location, etc., and is a reason why an average or moving average rather than a fixed temperature setting is used in this example.

Determining whether the temperature steady indicator is satisfied may be determined using the following example pseudo-code. However, it shall be understood that other methods of determining whether the temperature steady indicator is satisfied may be used, and that the disclosure is not limited in this respect:

Score 1 if Average Temp at Minutes t, t-1 and t-2< [Average of Moving Average Temps for Minutes t-4, t-3, t-2, t-1+65] and >[Average of Moving Average Temps for Minutes t-4, t-3, t-2, t-1−65] and score 0 otherwise, where the moving average temps are the average at time t for the Temps at times t, t-1 and t-2.

(2) AH(P) Decreasing from Maximum Value. In order for this indicator to be met, AH(P) must be decreasing from its maximum value for at least a specified number of sequential data points or a specified period of time. In one example, based on empirical data the specified number of data points was found to be a 3-minute period (or 3 data points in the example where data is sampled at 1-minute sampling intervals). For example, at each minute update interval, this indicator may be scored a 0 if the average AH(P) over a 3-minute period is not less than the maximum AH(P) observed so far, and may be scored a 1 otherwise. The maximum AH(P) may therefore be updated at each minute update interval. The following example pseudo-code may be used to determine whether the AH(P) decreasing indicator is satisfied:

At minute t, test if the average AH(P) at minutes t, t-1 and t-2 is less than the maximum AH(P) recorded so far and score 0 if no and 1 if yes.

(3) AH(P) Decreasing from Recent Values. In order for this indicator to be met, AH(P) must be decreasing from its recent values for at least a specified number of sequential data points (or, a specified period of time). For example, at time t, this indicator may be scored a binary 0 if the average AH(P) at minutes times t and t-1 is less than the average AH(P) at minutes t-2 and t-3.

(4) RH % Decreasing from Maximum Value. In order for this indicator to be met, RH % must be decreasing from its maximum value for at least a specified number of sequential data points. In one example, based on empirical data, the specified number of previous data points was found to be a 3 data points (or, a 3-minute period for the example where data is sampled at 1-minute sampling intervals). This indicator is similar to Indicator (2) described above and requires the maximum RH % observed be updated at each minute update interval. The following example pseudo-code may be used to determine whether the RH % decreasing indicator is satisfied:

At minute t, this indicator may be scored a binary 0 if the average RH % at minutes t, t-1, and t-2 is >=the maximum RH % recorded so far, and may be scored a binary 1 otherwise.

(5) Reference Point Angle Decreasing. This indicator involves the Reference Point Angle, an example of which was shown and described above with respect to FIG. 3. In order for this indicator to be met, the current reference point angle must be less than the reference point angle calculated for at least a specified number of previous data points. This indicator be checked only if State 5 (maximum reference point angle) is satisfied (e.g., has a value of 1). The following example psueudo-code may be used to determine whether this indicator is satisfied:

If State 5 is equal to 1, then at minute t compare the average of the reference point angles at minutes t, t-1, and t-2 to the average of the reference point angles at minutes t-3, t-4, and t-5 and score 0 if equal or greater than, and score 1 otherwise.

As mentioned above, a global indicator score may also be calculated. The global indicator score may be calculated as the sum of the one or more individual indicator values. The global indicator score may be updated each minute (or each sampling interval). As with the global state score, the global indicator score may have persistence so that once it has reached the maximum global indicator score, it will remain at the maximum global indicator score for the remainder of the dryer cycle. For example, if all 5 indicators must be met in order for a cycle to be dry, the maximum indicator score is 5, and once the global indicator score reaches 5 in a cycle, it will remain at 5 for the remainder of the dryer cycle.

As mentioned above, in order for a determination that Tdry has been reached (e.g., a determination that the textiles in the dryer are dry), one or more of the states and/or one or more of the indicators must be met. For example, only specified one(s), but not all, of the one or more states may be met for a determination that a load is dry. As another example, only specified one(s), but not all, of the one of more indicators may be met for a determination that a load is dry. As another example, all of the one or more states, and all of the one or more indicators may be met for a determination that a load is dry. In some examples, meeting of the specified one or more states and/or the one or more indicators is sufficient for a determination that a load is dry. Alternatively, in other examples, meeting of the one or more states and/or the one or more indicators may be necessary, but not sufficient, conditions for a determination that the load is dry.

For example, a dryness determination may include weighting considerations applied to one or more of the states and/or to one or more of the indicators.

Individual state weights may be applied to one or more of the individual states to achieve a more accurate determination of dryness than the individual state scores and/or the global state score may provide. The individual state weights may be used in place of or in addition to the individual state scores as part of the determination as to whether or not the load is dry. Likewise, individual indicator weights may be applied to one or more of the individual indicators to achieve a more accurate determination of dryness than the individual indicator scores and/or the global indicator score may provide. The individual indicator weights may be used in place of or in addition to the individual indicator scores as part of the determination as to whether or not the load is dry. In some examples, the weight(s) may increase the longer the state or indicator criterion has been met.

To determine the individual state weights, the dryer monitor may track the number of minutes that the global state score has been greater than a predetermined number. In this example, the dryer monitor tracks the number of minutes that the global state score has been greater than or equal to 5. However, it shall be understood that other values of the global state score could also be used, and that the disclosure is not limited in this respect.

Examples of individual state weights that may be applied to one or more of the states are listed in Table 2. In this example, for each minute after the global state score is ≥5, if an individual state score=1, the individual state weight is determined based on the corresponding weight listed in Table 2. Column 1 of Table 2 lists the number of minutes that the global state score has been greater than or equal to a predetermined number (also referred to herein as Minute(I)), and column 2 lists an example weight that may be applied at each corresponding minute (also referred to herein as Weight(I)).

In this example, if the global state score is less than 5 the state weight at the one-minute update interval would be zero. Once the global state score is ≥5 and the individual state score=1, the state weight at that minute would be the sum of weight from the corresponding minute in Table 2 and the weight from the previous minute. Thus, if the first minute at which the individual state score=1 is minute 9, the state weight at minute 9 would be 0.746 (0.746 (corresponding weight for minute 9)+0 (weight for previous minute)). Similarly, for subsequent minutes, the state weight would be the sum of the state weight for the previous minute and the corresponding weight from Table 2 for the current minute. Thus, in this example, at minute 10, the state weight would be 0.746+0.683=1.429. The weights may be rounded if desired. As may be seen in Table 2, the longer the global state score has been 5 or above, the lower the corresponding weight.

Example pseudo-code to determine the individual state weight at any 1-minute update interval may be as follows:

If Individual State Score=1, then for each minute (I) that the global state score is greater than 5, State Weight(I)= State Weight(I-1)+Weight$_s$(I) (from Table 2).

TABLE 2

Example Individual State Weights (Weight$_S$(I)) for each minute the Global State Score ≥5 (Minute$_S$(I))

| Minute$_S$(I) | Weight$_S$(I) |
|---|---|
| 0 | 0.000 |
| 1 | 1.000 |
| 2 | 0.996 |
| 3 | 0.987 |
| 4 | 0.971 |
| 5 | 0.944 |
| 6 | 0.907 |
| 7 | 0.861 |
| 8 | 0.806 |
| 9 | 0.746 |
| 10 | 0.683 |
| 11 | 0.620 |
| 12 | 0.560 |
| 13 | 0.503 |
| 14 | 0.451 |
| 15 | 0.403 |
| 16 | 0.362 |
| 17 | 0.325 |
| 18 | 0.293 |
| 19 | 0.264 |
| 20 | 0.240 |
| 21 | 0.219 |
| 22 | 0.200 |
| 23 | 0.184 |
| 24 | 0.170 |
| 25 | 0.158 |
| 26 | 0.147 |
| 27 | 0.138 |
| 28 | 0.129 |
| 29 | 0.122 |
| 30 | 0.116 |
| 31 | 0.110 |
| 32 | 0.105 |
| 33 | 0.100 |
| 34 | 0.096 |
| 35 | 0.092 |
| 36 | 0.089 |
| 37 | 0.086 |
| 38 | 0.083 |
| 39 | 0.081 |
| 40 | 0.079 |
| 41 | 0.077 |
| 42 | 0.075 |
| 43 | 0.073 |
| 44 | 0.072 |
| 45 | 0.070 |
| 46 | 0.069 |
| 47 | 0.068 |
| 48 | 0.067 |
| 49 | 0.066 |
| 50 | 0.065 |
| 51 | 0.064 |
| 52 | 0.063 |
| 53 | 0.063 |
| 54 | 0.062 |
| 55 | 0.061 |
| 56 | 0.061 |
| 57 | 0.060 |
| 58 | 0.060 |
| 59 | 0.059 |
| 60 | 0.059 |

In some examples, if the previous State Weight was greater than 1 and the individual state score goes from 1 to zero, the system may subtract 1 (or some other appropriate value) from the previous State Weight value. This may have the effect of penalizing the state weight for those cycles where it dropped back out of the state.

A raw global state weight may then be determined using, for example, the following equation when the global state score (the sum of the individual state scores) is greater than or equal to a predetermined number (5 in this example).

If Global State Score≥5, then $$\text{Raw Global State Weight} = \sqrt{(\text{Sumof8IndividualStateWeights})}$$

Figure 11:
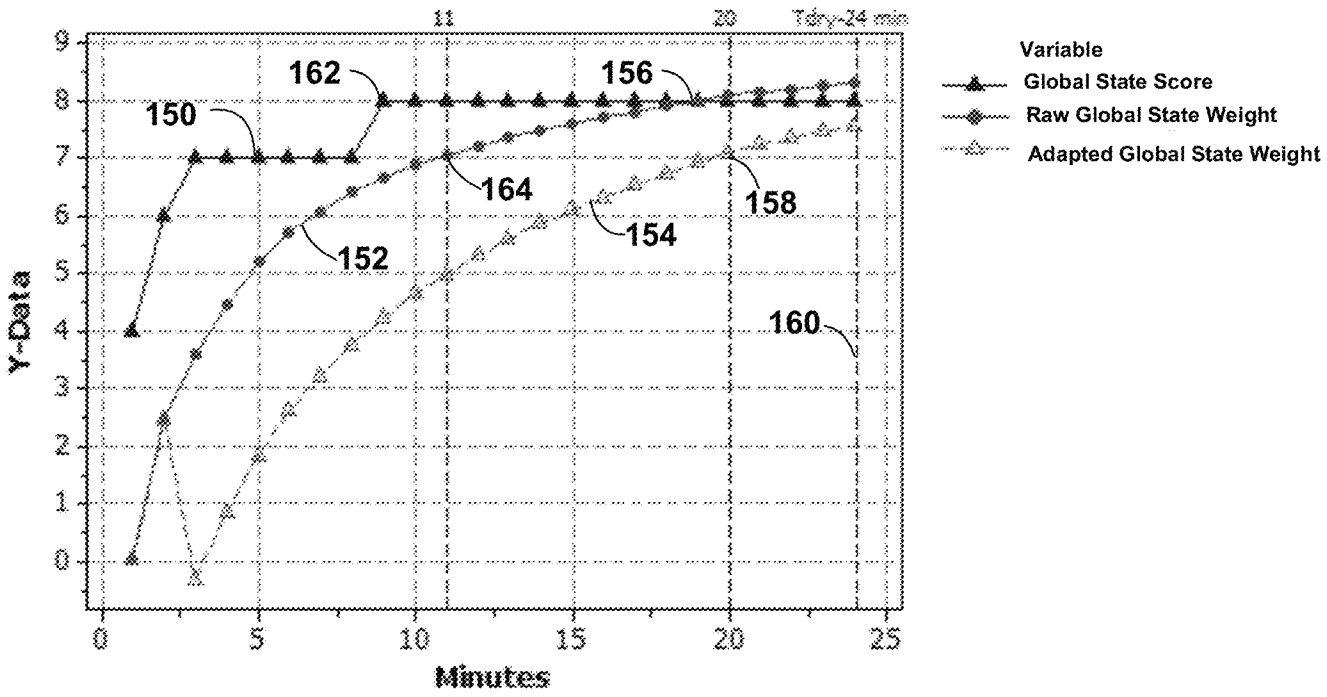
FIG. 11 is a graph illustrating the effect of a state weighting scheme on a dryer cycle exhibiting so-called "fast riser" characteristics.

FIG. 11 shows a graph illustrating application of example weighting schemes to the data of an example dryer cycle. Curve 150 represents the global state score versus time for the example dryer cycle. Curve 152 represents the raw global state weight versus time for the example dryer cycle. A comparison of curve 150 with curve 152 indicates that application of the individual state weights have had the effect of slowing down the rate at which the individual state weights are accumulating. That is, the raw global state weight did not reach 8 (in this example, 8 is the total number of states) until about 19 minutes into the cycle (indicated by reference numeral 156), whereas the global state score reached 8 at about 9 minutes into the cycle (indicated by reference numeral 162). This would result in a dryness determination much closer to the empirically determined Tdry, which was 24 minutes in this example.

Weights may also be applied to one or more of the indicators. For example, weights may be applied once the Global Indicator Score has reached a predetermined number. As with the state weights, there may be both raw individual and global indicator weights.

To determine individual indicator weights, the dryer monitor may track the number of minutes that the global indicator score has been greater than a predetermined number. In this example, the dryer monitor tracks the number of minutes that the global indicator score ≥3. However, it shall be understood that other values could also be used, and that the disclosure is not limited in this respect.

Examples of weights that may be applied to one or more of the indicators are listed in Table 3. In this example, for each minute after the global indicator score is ≥3, if an individual indicator score=1, the indicator weight is determined based on the weights listed in Table 3. Column 1 of Table 3 lists the number of minutes that the global indicator score has been greater than or equal to a predetermined number (also referred to herein as Minute$_{Ind}$(I)), and column 2 lists an example weight that may be applied at each corresponding minute (also referred to herein as Weight$_{Ind}$(I)).

In this example, if the global indicator score is less than 3 the individual indicator weight at the one-minute update interval would be zero. Once the global indicator score is ≥3 and the individual indicator score=1, the individual indicator weight at that minute would be the sum of weight from the corresponding minute in Table 3 and the weight from the previous minute. Thus, if the first minute at which the individual indicator score=1 is minute 8, the individual indicator weight at minute 8 would be 0.943 (0.943 (corresponding indicator weight for minute 8)+0 (weight for previous minute)). Similarly, for subsequent minutes, the indicator weight would be the sum of the indicator weight for the previous minute and the corresponding indicator weight from Table 3 for the current minute. Thus, in this example, at minute 9, the individual indicator weight would be 0.943+0.929=1.872. The weights may be rounded if desired. As may be seen in Table 3, the longer the global indicator score has been at or above the predetermined value, the lower the corresponding indicator weight.

TABLE 3

Example Individual Indicator Weights ($Weight_{Ind}(I)$) for each minute Global Indicator Score ≥5 ($Minute_{Ind}(I)$)

| $Minute_{Ind}(I)$ | $Weight_{Ind}(I)$ |
|---|---|
| 0 | 0.000 |
| 1 | 0.999 |
| 2 | 0.996 |
| 3 | 0.992 |
| 4 | 0.985 |
| 5 | 0.977 |
| 6 | 0.967 |
| 7 | 0.956 |
| 8 | 0.943 |
| 9 | 0.929 |
| 10 | 0.914 |
| 11 | 0.897 |
| 12 | 0.880 |
| 13 | 0.863 |
| 14 | 0.844 |
| 15 | 0.826 |
| 16 | 0.806 |
| 17 | 0.787 |
| 18 | 0.768 |
| 19 | 0.748 |
| 20 | 0.729 |
| 21 | 0.709 |
| 22 | 0.690 |
| 23 | 0.671 |
| 24 | 0.653 |
| 25 | 0.635 |
| 26 | 0.617 |
| 27 | 0.599 |
| 28 | 0.583 |
| 29 | 0.565 |
| 30 | 0.550 |
| 31 | 0.534 |
| 32 | 0.519 |
| 33 | 0.505 |
| 34 | 0.491 |
| 35 | 0.477 |
| 36 | 0.464 |
| 37 | 0.451 |
| 38 | 0.439 |
| 39 | 0.427 |
| 40 | 0.415 |
| 41 | 0.404 |
| 42 | 0.394 |
| 43 | 0.383 |
| 44 | 0.374 |
| 45 | 0.364 |
| 46 | 0.355 |
| 47 | 0.345 |
| 48 | 0.338 |
| 49 | 0.329 |
| 50 | 0.321 |
| 51 | 0.314 |
| 52 | 0.306 |
| 53 | 0.299 |
| 54 | 0.293 |
| 55 | 0.266 |
| 56 | 0.280 |
| 57 | 0.274 |
| 58 | 0.268 |
| 59 | 0.262 |
| 60 | 0.257 |

The indicator weight at any 1-minute update interval in may be determined using the following example pseudo-code:

If Individual Indicator Score=1, then for each minute that the global indicator score is greater than 3, Indicator Weight(I)=Indicator Weight(I-1)+$Weight_{Ind}(I)$ (from Table 3);

In some examples, if the previous individual indicator weight was greater than 1 and individual indicator score goes from 1 to zero, a penalty may be applied to the indicator weight. For example, the value 2 may be subtracted from the previous individual indicator weight value for all indicators except the indicator indicative of a decreasing reference point angle decreasing, where the value 1 may be subtracted 1 from the previous individual indicator weight value. It shall be understood, however, that other penalty values may be used to adjust the individual indicator weight values or the individual state weight values, and that the disclosure is not limited in this respect.

The raw global indicator weight may be a composite of one or more of the individual indicator weights. In this example, the raw global indicator weight is a composite of the five indicators described above and may be calculated after the Minute Indicator criterion has been met (e.g., the Global Indicator Score≥3). For example, the following equation may be used to determine the Raw Global Indicator Weight:

If Global Indicator Score≥3, then $$\text{Raw Global Indicator Weight} = \sqrt{(\text{Sumof5IndividualIndicatorWeights})}$$

In some examples, there may be dryer conditions which may result in an early false positive indication of dryness. That is, the one or more required states and/or the one or more required indicators may be satisfied even though the textiles in the dryer are not yet dry. In these cases, the dryer monitor may erroneously signal that the load is dry too early.

To address these issues, the dryer monitor may include an adaptive weighting scheme. If the dryer monitor detects certain data trajectory conditions associated with early alarms, the raw global state weight and/or the raw global indicator weight may be adjusted or "adapted" depending on the severity of the condition.

One such example data trajectory will be referred to herein as a "fast riser" data trajectory. In some examples, the dryer monitor algorithm may detect this or other dryer conditions and adjust the raw global state weight and/or the raw global indicator weight to reduce the risk of an early alarm. The adaptive weighting scheme may alter the rate at which these weights are increasing over time so there is less chance the algorithm will signal that the load is dry too early.

To detect a fast riser cycle, the dryer monitor may determine the number of cycle minutes when the global state score is first greater than or equal to a predetermined global state score threshold. In one example, the fast riser global state score threshold may be a global state score of 7. The corresponding number of minutes at which the global state score threshold is satisfied is compared to a fast riser time threshold. In this example, the fast riser time threshold may be greater than or equal to 4 minutes. A fast riser flag may be set if the fast riser time threshold is satisfied. The fast riser flag indicates that the current dryer cycle is a fast riser cycle.

The dryer monitor has the capability to detect some fast risers and adjust the weighting scheme to decrease the chance of an early signal. Although the system may not detect all fast riser dryer cycles, the capability to detect some fast risers and adjust the weighting scheme may decrease the chance of an early dry signal.

The dryer monitor may also determine the raw global state weight when global state score threshold is satisfied. For example, the dryer monitor may determine the raw global state weight at the number of cycle minutes when the global state score is first greater than or equal to 7.

If a dryer cycle is identified as being a fast riser, a fast riser weight factor may be applied the raw global state weight. For example, Table 4 lists example fast riser weight factors that may be used to adjust the raw global state weight. Column 1 lists the raw global state weight when the global state score is greater than or equal to the global state score threshold, and column 2 lists the corresponding fast riser weight factor. For example, if the raw global state weight when the global state score is greater than or equal to the global state score threshold is 2, the fast riser weight factor is 1. Similarly, if the raw global state weight when the global state score is greater than or equal to the global state score threshold is 7, the fast riser weight factor is 0.005.

TABLE 4

Example lookup table for fast riser weight factor.

| Raw State Weight @ State = 7 | Weight Factor |
|---|---|
| 1 | 1 |
| 2 | 1 |
| 3 | 0.04 |
| 4 | 0.03 |
| 5 | 0.02 |
| 6 | 0.01 |
| 7 | 0.005 |
| 8 | 0.005 |
| 9 | 0.005 |
| 10 | 0.005 |
| 11 | 0.005 |
| 12 | 0.005 |
| 13 | 0.005 |
| 14 | 0.005 |
| 15 | 0.005 |
| 16 | 0.005 |
| 17 | 0.005 |
| 18 | 0.005 |
| 19 | 0.005 |
| 20 | 0.005 |

The fast riser weight factor may be used to adjust the raw global state weight for those cycles that are identified as fast risers. A fast riser state adjustment value based on the weight factor may be determined as follows:

If the fast riser status is equal to 1, then obtain the Fast Riser State Adjustment Value using:

If at a minute update interval the raw global state weight is ≥3, then

Fast Riser State Adjustment Value=5*(2.71828183)$^{-(2VW)}$ and otherwise score the Fast Riser State Adjustment Value as zero where V=fast riser weight factor from Table 4, W=Number of minutes in dryer cycle, and 2.71828183 is the approximate value of the irrational constant e.

Similarly, the fast riser weight factor may be used to adjust the raw global indicator weight for those cycles identified as fast risers. A fast riser indicator adjustment value based on the weight factor may be determined as follows:

If the fast riser status is equal to 1, then obtain the Fast Riser Indicator Adjustment Value using:

If at a minute update interval the raw global indicator weight is ≥3, then

Fast Riser Indicator Adjustment Value=4*(2.71828183)$^{-(2XY)}$ and otherwise score the Fast Riser Indicator Adjustment Value as zero where X=fast riser weight factor from Table 4, Y=Number of minutes in dryer cycle, and 2.71828183 is the approximate value of the irrational constant e.

The Fast Riser State Adjustment Value and the Fast Riser Indicator Adjustment Value may be used to adjust the Raw Global State Weight and/or the Raw Global Indicator Weight, respectively, to arrive at an Adapted Global State Weight and/or an Adapted Global Indicator Weight. For example, if the fast riser status flag is equal to 1 (i.e., the dryer cycle has been identified as a fast riser):

Adapted Global State Weight=(Raw Global State Weight)−(Fast Riser State Adjustment Value)

Similarly, if the fast riser status flag is equal to 1 (i.e., the dryer cycle has been identified as a fast riser):

Adapted Global Indicator Weight=(Raw Global Indicator Weight)−(Fast Riser Indicator Adjustment Value)

If the cycle is not a fast riser, then the system would use the raw global state weight and the raw global indicator weight. In some examples, if the global state score falls below 5 (or some other predetermined value) after having been ≥5, then the raw global state weight may be reset to zero. Similarly, if the global indicator score falls below 3 (or some other predetermined value) after having been ≥3, then the raw global indicator weight may be reset to zero.

FIG. 11 shows a graph illustrating application of example weighting schemes to the data of an example dryer cycle. This example dryer cycle exhibits "fast riser" characteristics. As mentioned above, a fast riser dryer cycle may exhibit a global state score reaching high levels earlier in the cycle than may be typically observed. The impact in most cases is the algorithm signals too early, although in some cases the algorithm can signal too late.

For example, curve 150 of FIG. 11 is the global state score (the sum of the individual binary state scores) for the example dryer cycle. In this example, each of the 8 states described above were used. At minute 1, 4 states were satisfied; at minute 3, 7 states were satisfied, and at minute 9 all 8 states were satisfied. In this example, if only the 8 states were used to determine dryness, a dry signal would have been issued at 9 minutes, which is too early compared to the empirically determined Tdry time of 24 minutes. If 7 states were used to determined dryness, a dry signal would have been issued at 3 minutes, which is again too early compared to the empirically determined Tdry time.

Curve 152 shows a raw global state weight (the square root of the sum of the individual state weights as shown in eq. (3), for example) at each minute of the example dryer cycle. In this example, if the condition that the Raw Global State Weight ≥7 were used to determined dryness, a dry signal would have been issued at 11 minutes (indicated by reference numeral 164), which again is too early compared to the empirically determined Tdry time of 24 minutes.

Curve 154 shows an adapted global state weight at each minute of the example dryer cycle. In this example, if the condition that the Adapted Global State Weight ≥7 were used to determined dryness, a dry signal would have been issued at 20 minutes (indicated by reference numeral 158), which is much closer to the empirically determined Tdry time of 24 minutes.

Figure 12:
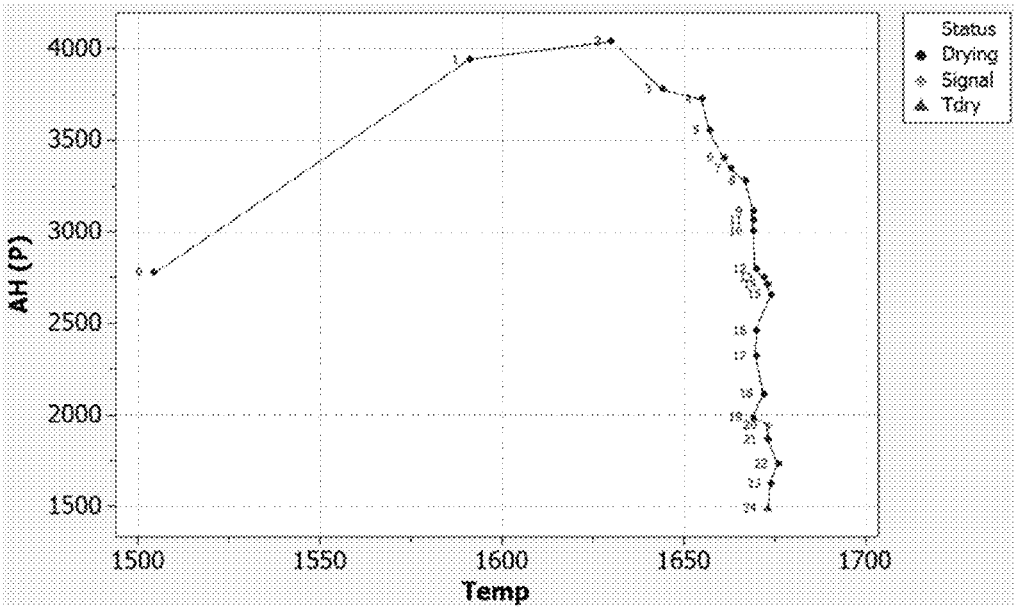
FIG. 12 shows another example of a fast riser dryer cycle trajectory in the AH(P) versus temperature 2-D space using 1-minute sample data.

FIG. 12 shows another example of a fast riser dryer cycle trajectory in the AH(P) versus temperature 2-D space using 1-minute sample data. A fast riser trajectory is one that follows the typical inverted-U pattern in the AH(P)-temperature space but with the descent period around the temperature set-point starting earlier than is typically observed. In this example, the descent phase is reached in 3-4 minutes versus the 8-12 minutes more commonly observed.

In addition to fast riser dryer cycles, other types of dryer conditions may exist that may result in an early false determination of dryness. One such dry cycle condition may be referred to as a "deep dive." A deep dive dryer cycle trajectory may be observed in the AH(P), temperature 2-D space, and is one that follows the typical inverted-U pattern but with the descent oscillating around the dryer temperature set-point for a much longer amount of time than is typically observed. The consequence for the dryer monitor algorithm may be early dry signals. That is, analysis of the dryer data using the Global State Score and the Global Indicator Scores may indicate that the load is dry, but Tdry actually occurs some time later, such as from 5 to 20 minutes after the initial determination of dryness.

Other types of dryer conditions leading to early false determinations of dryness may also be detected and taken into account. Various adaptive weighting schemes may be applied to these types of data trajectories to reduce the possibility of early alarms.

As discussed above, in some examples one or more of the states and/or one or more of the indicators may be used to determine whether textiles in a dryer are dry. In other examples, a determination of dryness may also require that certain of the weights are also met. In one example, there are four criteria that must be met in order to determine that a load is dry:

1. Global State Score=8 (i.e., all of the states must be met)
2. Raw or Adapted Global State Weight≥8
3. Global Indicator Score=5 (i.e., all of the indicators must be met)
4. Raw or Adapted Global Indicator Weight≥7

Each of the criteria may be examined every minute update interval, or on some other periodic basis. In the example where the criteria are examined each minute, the dryer monitor may determine that the textiles are dry the first minute when all four criteria are met.

In other examples, different criteria may be used to determine whether a load is dry. For example, the criteria may include that at least one state must be met in order to determine that a load is dry. The criteria may include that at least one indicator must be met in order to determine that a load is dry. The criteria may include that raw or adapted global state weight must satisfy a threshold value in order to determine that a load is dry. The criteria may include that raw or adapted global indicator weight must satisfy a threshold value in order to determine that a load is dry. As another example, the criteria may include that one or more of the states must be met in order to determine that a load is dry. The criteria may include that one or more of the indicators must be met in order to determine that a load is dry. Alternatively, the criteria may include some combination of any of these.

The criteria may be adjusted so that the dryness determination meets criteria set forth by the persons or organization for which the dryness determination is being made. For example, some organizations may want the dryness determination to be made such that a minimum percentage of dryer cycles signal dry within a defined number of minutes of Tdry. For example, the criteria may be that over 85% of the dryer cycles signal dry within −3 to +5 minutes of Tdry (in this case, the criteria may help to ensure that most dryer cycles signal dry fairly close to Tdry, may be an acceptable amount of time before Tdry (e.g., −3 minutes), or are not signaling dry too long after Tdry (e.g., +5 minutes). As another example, the criteria may be that all dryer cycles signal dry within 0 to +10 minutes of Tdry (in this case, the criteria may help to ensure that the dryer rarely if ever signals dry too early). It shall be understood, therefore, that although specific results and specific numeric values may be shown and described herein, that the disclosure is not limited in this respect, and that the values may be adjusted or varied depending upon the desired results to be achieved and also based on the test cycle data obtained.

In the examples shown and described above, dryer monitor 100 is associated with a single dryer 10. However, in other examples, dryer monitor 100 may be associated with multiple dryers. For example, dryer monitor 100 may receive information concerning whether textiles in one or more of a plurality of dryers are dry from a plurality of temperature and humidity sensor, wherein each dryer has its own associated set of temperature and humidity sensors. In this way, dryer monitor 100 may monitor dryer information for one or more dryers at a laundry location or a group of laundry locations. Such a feature may be useful, for example, in locations with more than one dryer, such as hotels or other commercial laundry establishments. In such example environments, dryer monitor 100 may be mounted on one of the plurality of dryers or may be located in a central control area rather than mounted on a dryer front.

Dryer monitor 100 may also track the amount of time the dryer operates in the overdry condition to further calculate and store information concerning excess energy usage and the cost associated with that excess energy usage. For example, knowing the amount of time the dryer operates in the overdry condition, and knowing certain specifications of the dryer such as average energy usage per unit time, dryer monitor 100 may calculate the amount of excess energy unnecessarily expended in the overdry condition (that is, continuing to operate the dryer after the laundry is already dry). In addition, knowing the rate of utility cost per unit time, dryer monitor 100 could also determine the cost of that excess energy usage. Tracking and reporting of excess energy usage and cost to management personnel may be very valuable for the overall management and operation of commercial laundry establishments. Analysis of this data, either locally by the dryer monitor or via a remote computer, may be used to generate reports concerning dryer operations and/or identify changes that occur with the dryer over time.

Similar reports may also be generated for any of the other dryer information, including information detected by the dryer sensors at the installation(s), information calculated by an analysis application, or other parameters described herein.

Figure 13:
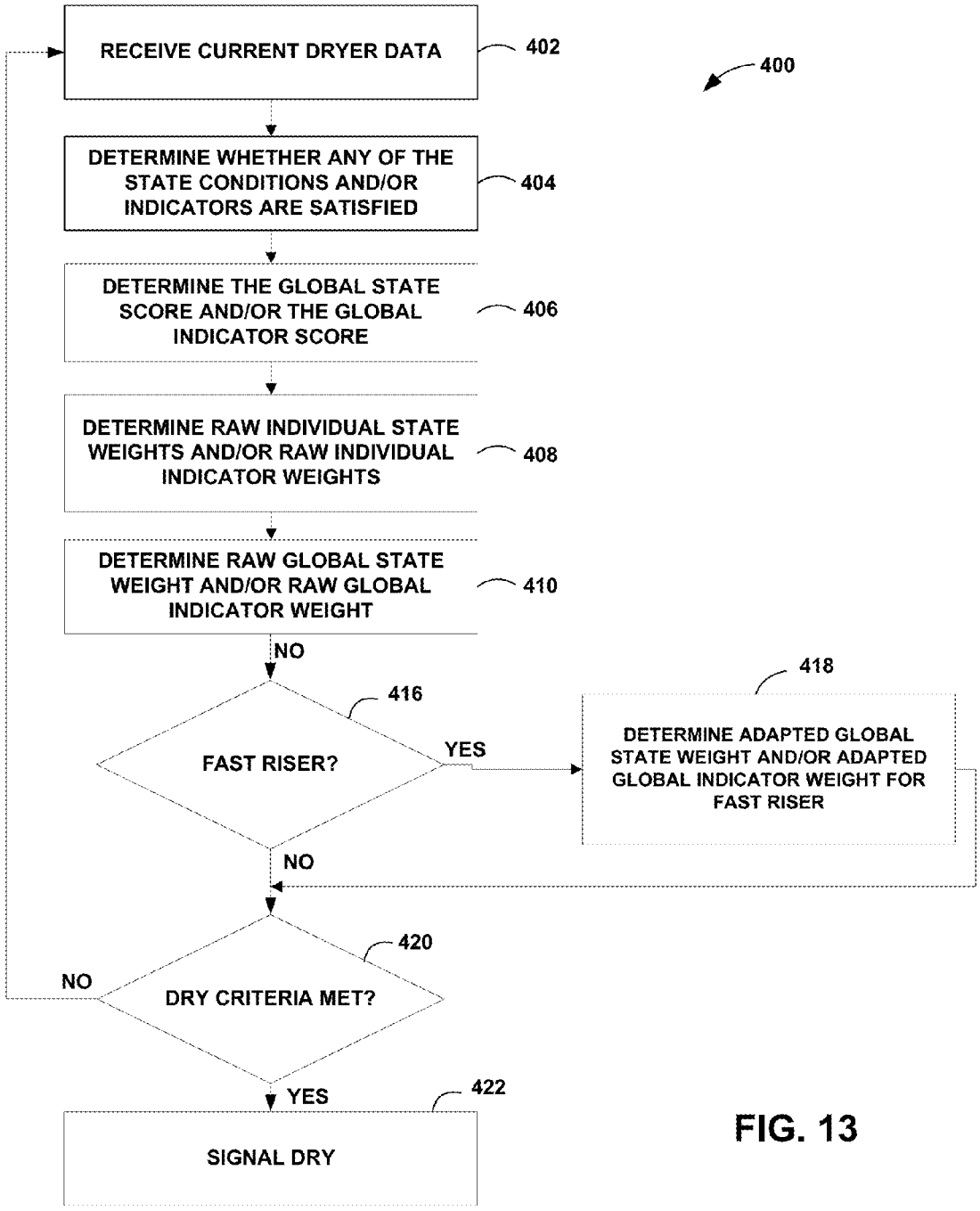
FIG. 13 is a flow chart illustrating an example process by which a dryer monitor may determine whether textiles in a dryer are dry.

FIG. 13 is a flow chart illustrating an example process (400) by which a dryer monitor may determine whether textiles in a dryer are dry. For example, a processor, such as processor(s) 42 in FIG. 2, or some other processor or computing device, may execute software which causes the processor to execute the process (400).

A processor receives the current dryer data (402). For example, a processor may receive current temperature and humidity information from one or more temperature or humidity sensors associated with a clothes dryer. Alternatively, the data may be stored temperature and humidity data that is analyzed at a later time. The process may analyze the dryer data to determine whether any of the one or more states and/or any of the one or more indicators are satisfied (404). The process may determine the global state score and the global indicator score (406).

In some examples where a weighting scheme is to be implemented, the process may further determine the raw individual state weights and the raw individual indicator weights (408). The process may further determine the raw global state weight and the raw global indicator weight (410).

In some examples where an adaptive weighting scheme is implemented to account for various types of dryer cycle conditions, the process may further determine whether the current dryer cycle is a "fast riser" cycle (416). If the dryer cycle is a fast riser cycle, the process may calculate adapted individual state weights, adapted individual indicators weights, an adapted global state weight, and an adapted global indicator weight for fast riser cycles (418).

The process may then analyze dry criteria to arrive at a determination as to whether a dry signal is warranted (420). If the dry criteria are met, the dryer monitor may signal that the load is dry (422). If the dry criteria are not met, the dryer monitor may thus receive the current dryer data from the next update interval (402) and continue the analysis to determine whether the dry criteria are met with the dryer data from the next update interval.

In some examples, the dryer monitor may encompass one or more computer-readable media comprising instructions that cause a processor, such as processor 42, to carry out the methods described above. A "computer-readable medium" includes but is not limited to read-only memory (ROM), random access memory (RAM), non-volatile random access memory (NVRAM), electrically erasable programmable read-only memory (EEPROM), flash memory a magnetic hard drive, a magnetic disk or a magnetic tape, a optical disk or magneto-optic disk, a holographic medium, or the like. The instructions may be implemented as one or more software modules, which may be executed by themselves or in combination with other software. A "computer-readable medium" may also comprise a carrier wave modulated or encoded to transfer the instructions over a transmission line or a wireless communication channel. Computer-readable media may be described as "non-transitory" when configured to store data in a physical, tangible element, as opposed to a transient communication medium. Thus, non-transitory computer-readable media should be understood to include media similar to the tangible media described above, as opposed to carrier waves or data transmitted over a transmission line or wireless communication channel.

The instructions and the media are not necessarily associated with any particular computer or other apparatus, but may be carried out by various general-purpose or specialized machines. The instructions may be distributed among two or more media and may be executed by two or more machines. The machines may be coupled to one another directly, or may be coupled through a network, such as a local access network (LAN), or a global network such as the Internet.

The dryer monitor may also be embodied as one or more devices that include logic circuitry to carry out the functions or methods as described herein. The logic circuitry may include a processor that may be programmable for a general purpose or may be dedicated, such as microcontroller, a microprocessor, a Digital Signal Processor (DSP), an Application Specific Integrated Circuit (ASIC), a field programmable gate array (FPGA), and the like.

One or more of the techniques described herein may be partially or wholly executed in software. For example, a computer-readable medium may store or otherwise comprise computer-readable instructions, i.e., program code that can be executed by a processor to carry out one of more of the techniques described above. A processor for executing such instructions may be implemented in hardware, e.g., as one or more hardware based central processing units or other logic circuitry as described above.

Various examples have been described. These and other examples are within the scope of the following claims.

The invention claimed is:

1. A method comprising:

receiving a current temperature associated with a dryer cycle of a clothes dryer for a number of sequential data points;

receiving a current humidity associated with the dryer cycle for the number of sequential data points;

calculating an absolute humidity (AH(P)) value based on the current temperature and the current humidity for each of the sequential number of data points;

identifying a maximum AH(P) value for the dryer cycle from among the AH(P) values calculated for each of the sequential number of data points;

comparing subsequent AH(P) values received subsequent to the maximum AH(P) value with the maximum AH(P) value;

determining whether the current temperature is higher than a temperature at the start of the dryer cycle;

determining that textiles in the clothes dryer are dry if at least the subsequent AH(P) values decrease from the maximum AH(P) value for at least a first predetermined number of sequential AH(P) values, the current temperature is higher than a temperature at the start of the dryer cycle, and the current temperature remains within a predetermined temperature range for at least a second predetermined number of sequential data points; and in response to determining that the textiles are dry, at least one of generating a dryness indicator on a user interface of the clothes dryer and turning off the clothes dryer.

2. The method of claim 1 wherein the specified period of time is at least 3 minutes.

3. The method of claim 1 wherein determining that the textiles in the clothes dryer are dry further comprises determining whether the dryer cycle has run for a minimum amount of time.

4. The method of claim 1 wherein determining that the textiles in the clothes dryer are dry further comprises determining whether a relative humidity is below a relative humidity reference value.

5. The method of claim 1 wherein determining that the textiles in the clothes dryer are dry further comprises determining whether the absolute humidity is below an absolute humidity reference value.

6. A dryer monitor comprising:

a temperature sensor that senses a current temperature associated with a dryer cycle of a clothes dryer for a number of sequential data points;

a humidity sensor that senses a current humidity associated with the dryer cycle for the number of sequential data points; and a controller that calculates an absolute humidity (AH(P)) value based on the current temperature and the current humidity information for each of the sequential number of data points, identifies a maximum AH(P) value for the dryer cycle from among the AH(P) values calculated for each of the sequential number of data points, compares subsequent AH(P) values received subsequent to the maximum AH(P) value with the maximum AH(P) value, determines whether the current temperature is higher than a temperature at the start of the dryer cycle, determines that textiles in the clothes dryer are dry if at least the subsequent AH(P) values decrease from the maximum AH(P) value for at least a predetermined number of sequential AH(P) values, the current temperature is higher than a temperature at the start of the dryer cycle, and the current temperature remains within a predetermined temperature range for at least a second predetermined number of sequential data points, and in response to determining that the textiles are dry, at least one of generating a dryness indicator on a user interface of the clothes dryer and turning off the clothes dryer.

7. A non-transitory computer readable medium encoded with instructions that cause one or more processors of a computing device to perform operations comprising:

receive a current temperature associated with a dryer cycle of a clothes dryer for a number of sequential data points;

receive a current humidity associated with the dryer cycle for the number of sequential data points;

calculate an absolute humidity (AH(P)) value based on the current temperature and the current humidity for each of the sequential number of data points;

identify a maximum AH(P) value for the dryer cycle from among the AH(P) values calculated for each of the sequential number of data points;

compare subsequent AH(P) values received subsequent to the maximum AH(P) value with the maximum AH(P) value;

determine whether the current temperature is higher than a temperature at the start of the dryer cycle;

determine that textiles in the clothes dryer are dry if at least the subsequent AH(P) values decrease from the maximum AH(P) value for at least a predetermined number of sequential AH(P) values, the current temperature is higher than a temperature at the start of the dryer cycle, and the current temperature remains within a predetermined temperature range for at least a second predetermined number of sequential data points; and in response to determining that the textiles are dry, at least one of generate a dryness indicator on a user interface of the clothes dryer and turn off the clothes dryer.

* * * * *